US006125251A

United States Patent [19]

Shiraishi et al.

[11] Patent Number: 6,125,251

[45] Date of Patent: Sep. 26, 2000

[54] IMAGE FORMING DEVICE HAVING INTERNAL ACCESS CAPABILITY

[75] Inventors: Yoshinori Shiraishi, Yamatokoriyama; Hidetoshi Kaneko; Yoshinori Hayashi, both of Soraku-gun; Yasushi Matsutomo; Minoru Tomiyori, both of Nara, all of Japan

[73] Assignee: Sharp Kabushiki Kaisha, Osaka, Japan

[21] Appl. No.: 09/291,864

[22] Filed: Apr. 14, 1999

[30] Foreign Application Priority Data

Apr. 14, 1998 [JP] Japan ..... 10-102323

[51] Int. Cl.[7] ..... G03G 21/16

[52] U.S. Cl. ..... 399/124; 399/18; 399/110

[58] Field of Search ..... 399/124, 110, 399/18, 107, 401; 347/152, 170, 245, 263

[56] References Cited

U.S. PATENT DOCUMENTS

| | | | |
|---|---|---|---|
| 3,713,735 | 1/1973 | Wilber | 399/124 |
| 5,293,203 | 3/1994 | Wada et al. | 399/124 |
| 5,587,769 | 12/1996 | Sawada et al. | 399/110 X |
| 5,884,123 | 3/1999 | Stickney et al. | 399/110 X |
| 5,887,228 | 3/1999 | Motohashi et al. | 399/124 X |
| 5,897,244 | 4/1999 | Miyazaki et al. | 399/124 X |

FOREIGN PATENT DOCUMENTS

| | | |
|---|---|---|
| 1-92135 | 4/1989 | Japan . |
| 6-73005 | 10/1994 | Japan . |
| 8-18724 | 2/1996 | Japan . |
| 8-152756 | 6/1996 | Japan . |

*Primary Examiner*—Susan S. Y. Lee

*Attorney, Agent, or Firm*—David G. Conlin; David A. Tucker

[57] ABSTRACT

Front and side surfaces of an image forming device are provided with a front cover and a side cover, respectively, which cover an image forming section, and which can be opened and closed. A supporting hinge of the side cover is provided along a lateral edge thereof toward the rear of the main body of the device, and the side cover opens to widely expose a lower portion of the image forming section. Further, by means of an obstructing body provided integrally with the front cover, the front and side covers are given an order of opening and closing.

21 Claims, 20 Drawing Sheets

IMAGE FORMING DEVICE HAVING INTERNAL ACCESS CAPABILITY

FIELD OF THE INVENTION

The present invention relates to an image forming device, in particular to an image forming device having a door provided in a side of the main body of the device, which can be opened and closed.

BACKGROUND OF THE INVENTION

Conventionally, many image forming devices such as copy machines and laser printers are structured so that, in the event of a paper jam in a paper transport channel of the device, the upper part of the paper transport channel can be opened by moving some of the members making up the paper transport channel. For example, Japanese Examined Patent Publication No. 8-18724/1996 (Tokukouhei 8-18724, published on Feb. 28, 1996) discloses an image forming device, a side of the main body of which is provided with a side cover integrally provided with some of the structural members making up a paper transport channel, a transport surface of which, when paper jams therein, can be partially exposed by swinging open the side cover, allowing the jammed paper to be removed.

However, in the image forming device disclosed in Japanese Examined Patent Publication No. 8-18724 above, a supporting hinge of the side cover, integrally provided with some of the structural members of a vertical pass of the paper transport channel, is provided in the lower part of the side of the device main body, so that the upper part of the vertical pass of the paper transport channel can be opened out from the device main body. For this reason, if obstructing objects such as books are set next to the device main body on the side cover side, the paper channel cannot be fully opened out from the device main body. Accordingly, problems with this conventional device are that jammed paper is difficult to remove from the paper transport channel, paper sometimes rips, and paper of small size is especially difficult to remove. Moreover, since the paper transport channel turns sharply in the vicinity of a PS (Paper Stop) roller provided in the lower part of the main body, paper easily jams there. However, with the foregoing structure, the lower part of the device main body cannot be exposed by opening the side cover, and thus paper jammed in the lower part of the paper transport channel is particularly difficult to remove.

Further, some conventional image forming devices are structured so that the interior of the device can be exposed to allow performance of operations such as maintenance of the device. For example, Japanese Unexamined Patent Publication No. 8-152756/1996 (Tokukaihei 8-152756, published on Jun. 11, 1996) discloses an image forming device provided with a side cover which can be opened to replace a device in need of replacement, such as a photosensitive drum, developing device, or cleaning device.

Among such image forming devices, some are provided with covers on two adjacent sides of the main body, which can be opened and closed, and which have an order of opening and closing. Structures for opening and closing covers in an image forming device of this type include the following.

For example, Japanese Unexamined Patent Publication No. 8-152756 above and Japanese Unexamined Utility Model Publication No. 6-73005/1994 (Jitsukaihei 6-73005) disclose an image forming device having an upper cover provided in the top and a side cover provided in the side of the main of the image forming device, in which one end of the side cover, which can be opened and closed, is provided with projections which engage with holes provided in the side of the device main body. The device main body, on the other hand, is provided with shielding members, etc. which shield the holes. By the action of closing the upper cover, the shielding members, etc. are pressed and moved, thus releasing shielding of the holes. After shielding of the holes has been released, the side cover can be closed.

However, in conventional structures like the foregoing, the upper cover and the side cover provided in adjacent sides of the device are given an order of opening and closing by means of separate structural members such as shielding members. Accordingly, not only is the number of members is increased, but the structure is also complicated, and cost is increased.

SUMMARY OF THE INVENTION

It is an object of the present invention to provide an image forming device which enables removal of jammed paper by partially opening a door provided in a side of the main body of the device, which can be opened and closed, without fully opening the door. It is a further object of the present invention to provide an image forming device which enables setting of an order of opening and closing of covers provided in the main body of the device by means of a simple structure.

In order to attain the former object above, an image forming device according to the present invention comprises a first transport channel located in a lower part of the device main body, which supplies transfer paper; a second transport channel located in a side part of the device main body, where an image is formed on transfer paper supplied from the first transport channel; and a first opening/closing structure provided on the side of the device main body where the second transport channel is provided, having in an upper or lateral part thereof a supporting hinge, on which the first opening/closing structure opens out from the device main body to expose at least a portion of the second transport channel toward the first transport channel.

In the foregoing structure, the first opening/closing structure, provided on the same side of the device main body as the second transport channel, has a supporting hinge in an upper or lateral part thereof. Accordingly, the lower part of the first opening/closing structure or the end thereof not provided with the supporting hinge can swing open widely from the device main body. In other words, the portion of the second transport channel toward the first transport channel, located in the lower part of the device main body, can be widely exposed.

Generally, since the transport channel turns sharply in the lower part of the second transport channel (toward the first transport channel), transfer paper easily jams there. In such a case, if the supporting hinge is provided in the lower part of the first opening/closing structure instead of in an upper or lateral part thereof, the lower end of the first opening/closing structure cannot be opened. Accordingly, the lower part of the second transport channel cannot be widely exposed, and it is difficult to remove the jammed paper.

For this reason, by means of the present image forming device, structured as above, the lower part of the second transport channel, where jams are likely to occur, can be opened, and thus the first opening/closing structure on the side of the device main body need not be fully opened.

Consequently, even when there is not much space next to the device main body, or when there are obstructing objects there, jammed paper can be easily removed without fully opening the first opening/closing structure.

Further, it is preferable for the foregoing image forming device to further include a second opening/closing structure, provided on a side of the device main body adjacent to the side where the first opening/closing structure is provided, which opens out from the device main body to expose the second transport channel.

With the foregoing structure, the first and second opening/closing structures are provided on two adjacent sides of the device main body. By opening the first and second opening/closing structures away from the device main body, a large extent of the second transport channel can be exposed.

Consequently, it is easy to perform maintenance such as replacement of parts, and removal of jammed paper.

Further, in order to attain the latter object above, the foregoing second opening/closing structure can be provided with an opening/closing restricting member, which prevents closing of the first opening/closing structure when the second opening/closing structure is open, and allows opening and closing of the first opening/closing structure when the second opening/closing structure is closed.

With the foregoing structure, by means of the opening/closing restricting member provided in the second opening/closing structure, the first opening/closing structure cannot be opened when the second opening/closing structure is open. Further, the opening/closing restricting member allows opening and closing of the first opening/closing structure when the second opening/closing structure is closed. Accordingly, the opening/closing structures must be opened in the order "first, then second opening/closing structure," and closed in the order "second, then first opening/closing structure."

By this means, the first and second opening/closing structures are given an order of opening and closing.

Further, in order to attain the latter object above, the foregoing second opening/closing structure can be provided with an opening/closing restricting member at an end of the second opening/closing structure toward the first opening/closing structure, which covers part of the first opening/closing structure when the first and second opening/closing structures are closed, and prevents opening and closing of the second opening/closing structure when the first opening/closing structure is closed.

With the foregoing structure, by means of the opening/closing restricting member provided in the second opening/closing structure, the first opening/closing structure cannot be opened when both the first and second opening/closing structures are closed. Further, when both the first and second opening/closing structures are open, if the second opening/closing structure is closed first, the first opening/closing structure cannot be closed. Accordingly, the opening/closing structures must be opened in the order "second, then first opening/closing structure," and closed in the order "first, then second opening/closing structure."

By this means, the first and second opening/closing structures are given an order of opening and closing.

Additional objects, features, and strengths of the present invention will be made clear by the description below. Further, the advantages of the present invention will be evident from the following explanation in reference to the drawings.

DESCRIPTION OF THE EMBODIMENTS

[FIRST EMBODIMENT]

The following will explain one embodiment of the present invention with reference to FIGS. 1 through 13.

Figure 1:
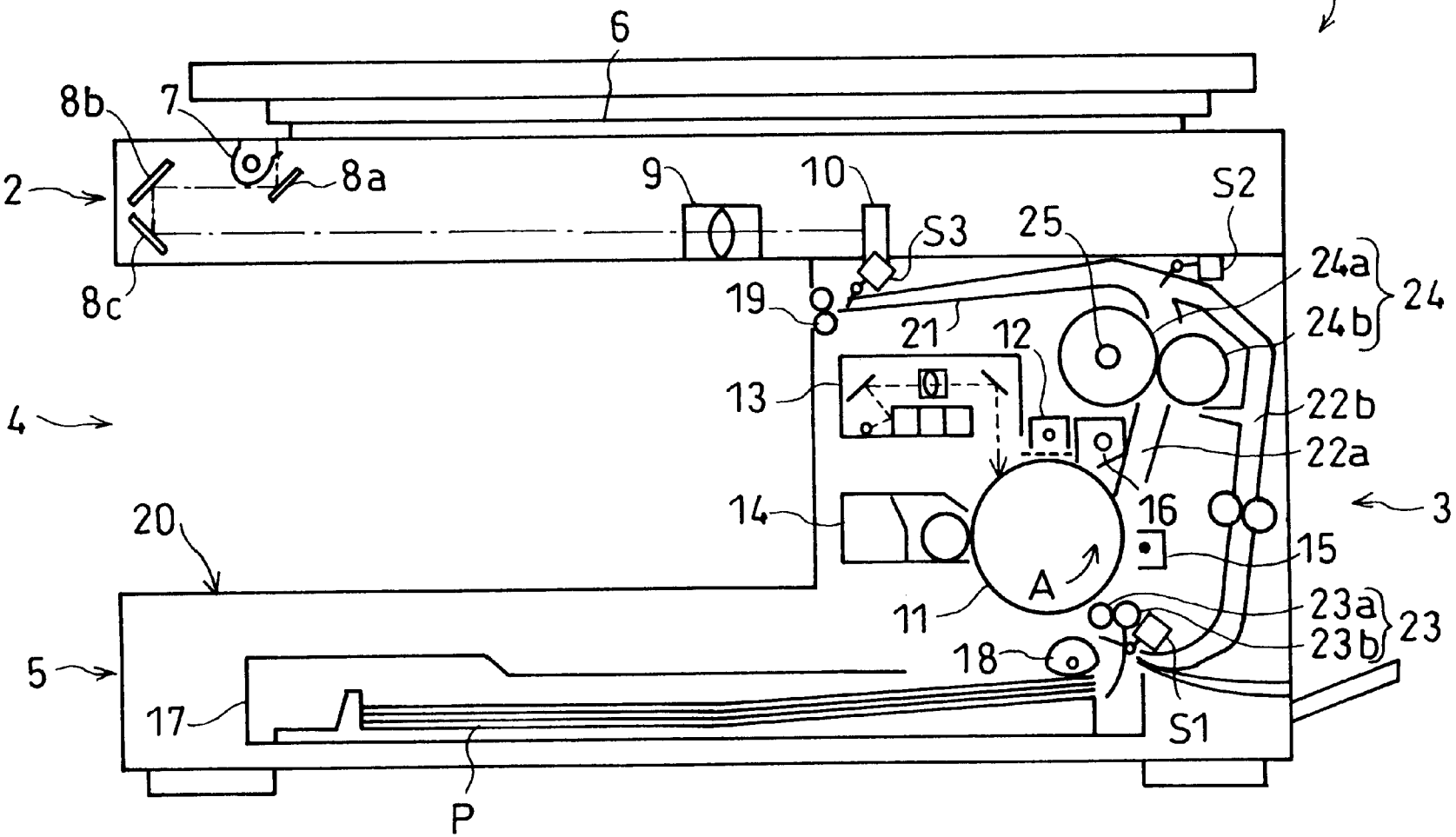
FIG. 1 is a front cross-sectional view schematically showing the structure of an image forming device according to the first embodiment of the present invention.

FIG. 1 is a cross-sectional view schematically showing the structure of an image forming device 1 according to the present embodiment. The image forming device 1 forms an image corresponding to an original image on the surface of paper by means of the electrophotographic process. The image forming device 1 is made up of an optical system device 2 (original reading section) provided in the upper part of a device main body, an image forming section 3 (including a second transport channel) and a discharge section 4 provided in the central part of the main body, and a paper supply section 5 (including a first transport channel) provided in the lower part of the main body. In other words, the image forming section 3 and the discharge section 4 are provided in a space between the optical system device 2 and the paper supply section 5, with the image forming section 3 toward one side and the discharge section 4 toward the other side of this space.

The optical system device 2 includes an original stand 6 made of a transparent glass body provided on the upper surface of the image forming device 1, and, provided below the lower surface of the original stand 6, an exposure lamp 7, mirrors 8*a* through 8*c*, a lens 9, and a CCD (Charge Coupled Device) 10, which is an optical conversion element.

The optical system device 2 reads an image from an original placed on the upper surface of the original stand 6. Specifically, the exposure lamp 7 and the mirrors 8*a* through 8*c* move forward and back parallel to the original stand 6, exposing the original image on the original stand 6 on each forward movement. Light from the exposure lamp 7 reflected by the surface of the original is focused on the CCD 10 via the mirrors 8*a* through 8*c* and the lens 9. The CCD 10 receives the light reflected by the surface of the original, and outputs photoreceptor signals in accordance with received light quantities.

The image forming section 3 includes a photosensitive drum 11 having a photoconductive layer, which rotates in the direction indicated by arrow A, and, provided around the periphery of the photosensitive drum 11, a charger 12, a laser writing unit 13, a developing device 14, a transfer charger 15, and a cleaning device 16, arranged in that order in the direction of rotation of the photosensitive drum 11 (the direction of the arrow A).

The image forming section 3 forms images by the electrophotographic process on a surface of a sheet of paper P (transfer paper) supplied from the paper supply section 5. Specifically, in a charging step, the charger 12 imparts a unipolar charge uniformly over the surface of the photosensitive drum 11. Next, in an exposure step, the laser writing unit 13 projects laser light onto the surface of the photosensitive drum 11 in accordance with the photoreceptor signals outputted by the CCD 10 of the optical system device 2. Then, in a developing step, the developing device 14 supplies to the surface of the photosensitive drum 11 toner having a charge opposite the charge imparted by the charger 12. Next, in a transfer step, the transfer charger 15 performs a corona discharge from the back of the paper P. The cleaning device 16 then removes excess toner from the surface of the photosensitive drum 11.

The paper supply section 5 includes a removable paper cassette 17 containing a plurality of sheets of paper P of a single size, and a paper supply roller 18 provided opposite the upper surface of the paper P contained in the paper cassette 17.

The paper supply section 5 supplies the paper P to the image forming section 3 one sheet at a time. Specifically, by means of rotation of the paper supply roller 18, the paper P in the paper cassette 17 is sent one sheet at a time toward the image forming section 3.

The discharge section 4 includes discharge rollers 19, a discharge tray 20, and a discharge transport channel 21, and, by means of rotation of the discharge rollers 19, discharges sheets of paper P with images corresponding to the original image formed thereon through the discharge transport channel 21 to the discharge tray 20.

The following will explain in detail transport paths for the paper P within the image forming section 3.

In the image forming section 3 is a main transport channel 22*a* (a channel for transporting the paper P), which extends from the paper supply section 5, through the image forming section 3, to the discharge section 4. The main transport channel 22*a*, along with a secondary transport channel 22*b* (to be discussed below), and the discharge transport channel 21, make up the paper transport paths. To be more specific, the main transport channel 22*a* extends from a point in the paper supply section 5 where the paper supply roller 18 is supported, through a space between the photosensitive drum 11 and the transfer charger 15 of the image forming section 3, to the discharge rollers 19 of the discharge section 4. Resist rollers 23 (23*a* and 23*b*) are provided in the main transport channel 22*a* between the paper supply roller 18 and the image forming section 3. Further, fixing rollers 24 (24*a* and 24*b*) are provided between the image forming section 3 and the discharge rollers 19.

By means of the foregoing structure, during image formation in the image forming device 1, an image is formed on a sheet of paper P by the following operations. First, the image of an original placed on the original stand 6 is inputted into the CCD 10 as light from the exposure lamp 7 reflected by the surface of the original. Photoreceptor signals outputted by the CCD 10 are sent to the laser writing unit 13 of the image forming section 3, and are converted into laser light which the laser writing unit 13 projects, in synchronization with the rotation of the photosensitive drum 11, onto the surface thereof, which has previously been given a uniform, unipolar charge by the charger 12. In this way, due to a photoconductive effect of the photoconductive layer provided on the surface of the photosensitive drum 11, an electrostatic latent image is formed thereon. This electrostatic latent image is then made visible by toner supplied from the developing device 14.

Meanwhile, prior to rotation of the photosensitive drum 11, a sheet of paper P is supplied to the image forming section 3 from the paper supply section 5. The supplied paper P stops in the main transport channel 22*a* with its leading edge touching the resist rollers 23.

Then, by means of a separate control mechanism (not shown), the resist rollers 23 begin to rotate with a timing based on the rotation of the photosensitive drum 11. The paper P is guided between the photosensitive drum 11 and the transfer charger 15 with a timing such that the leading edge of the paper P coincides with the leading edge of the toner image carried by the surface of the photosensitive drum 11. Then, by means of corona discharge by the transfer charger 15, the toner image carried by the surface of the photosensitive drum 11 is transferred to the surface of the paper P.

Toner remaining on the surface of the photosensitive drum 11 after passing a point opposite the transfer charger 15 is removed by the cleaning device 16. Thereafter, the charging step, exposure step, developing step, and transfer step are repeated.

The paper P onto which an image has been transferred passes through the main transport channel 22*a*, and is guided between the fixing rollers 24. The fixing rollers 24 are a heating roller 24*a*, the interior of which is provided with a heating lamp 25, and a pressure roller 24*b*, which presses against the heating roller 24*a* with a predetermined nip pressure. In passing between the fixing rollers 24, the paper P undergoes heating and application of pressure, thus fusing and fixing to the paper P the toner image carried on the surface thereof. After passing between the fixing rollers 24, the paper P is discharged through the discharge transport channel 21 and the discharge rollers 19 into the discharge tray 20.

The main transport channel 22*a* is provided with sensors S1 through S3, located in the vicinity of the resist rollers 23, the fixing rollers 24, and the discharge rollers 19, respectively, which detect the paper P. If one of the sensors S1 through S3 detects a sheet of paper P for more than a predetermined duration, which is based on the length of the paper P in the transport direction and the transport speed, the paper P is judged to have jammed.

When viewed from the front, the image forming device 1, with the optical system device 2 in the upper part, the image forming section 3 in the central part, and the paper supply section 5 in the lower part thereof, is shaped roughly as a rectangle open on the left side. In other words, the horizontal length of the optical system device 2 and the paper supply section 5 is longer than the vertical length of the image forming section 3.

The reason for this shape is to enable the optical system device 2 to read original images which are larger than the largest size of paper the paper supply section 5 is able to supply. With the foregoing shape, the surface dimensions of the optical system device 2, which takes up the largest surface area in the image forming device 1, can be made equal to the largest surface dimensions of the image forming device 1. The image forming section 3, whose horizontal length is shorter than that of the optical system device, 2, is provided below the optical system device 2, toward one side (in this case the right side). Further, the paper supply section 5 is provided below the image forming section 3. The discharge tray 20 is provided between the optical system device 2 and the paper supply section 5, in the space created to the left of the image forming section 3.

Figure 2:
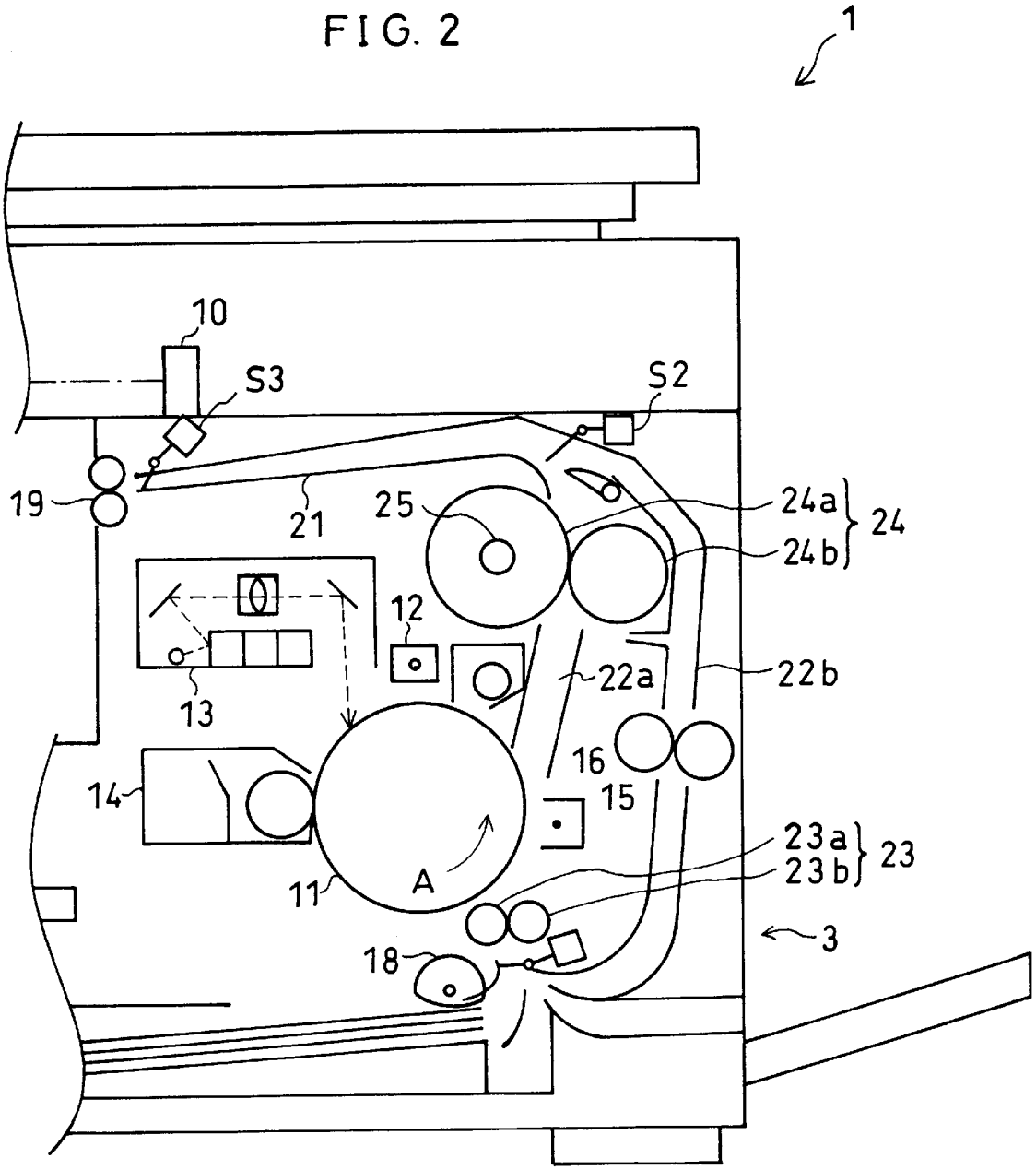
FIG. 2 is a cross-sectional view schematically showing the structure of a paper transport channel in the foregoing image forming device.

FIG. 2 is a drawing explaining the structure of the paper transport paths. As discussed above, in the image forming device 1, the main transport channel 22*a* is provided toward one side of the image forming section 3, and is a paper channel extending upward, which passes between the photosensitive drum 11 and the transfer charger 15, and between the fixing rollers 24. Further, the discharge transport channel 21, which is part of the discharge section 4, is provided above the image forming section 3, continuing from the upper end of the main transport channel 22*a*.

Between the main transport channel 22*a* and a side cover (first opening/closing structure), to be discussed below, is a secondary transport channel 22*b*, which is a paper channel connected at each end to the main transport channel 22*a*. The secondary transport channel 22*b* extends from the discharge transport channel 21 to the paper supply section 5. Specifically, the secondary transport channel 22*b* extends from the point where the main transport channel 22*a* and the discharge transport channel 21 meet to a point immediately before the resist rollers 23, and is provided to the side of the main transport channel 22*a* away from the photosensitive drum 11 (between the main transport channel 22*a* and the side cover to be discussed below) . In other words, the secondary transport channel 22*b* forms a paper channel shaped roughly as a rectangle open on the left.

Figure 3:
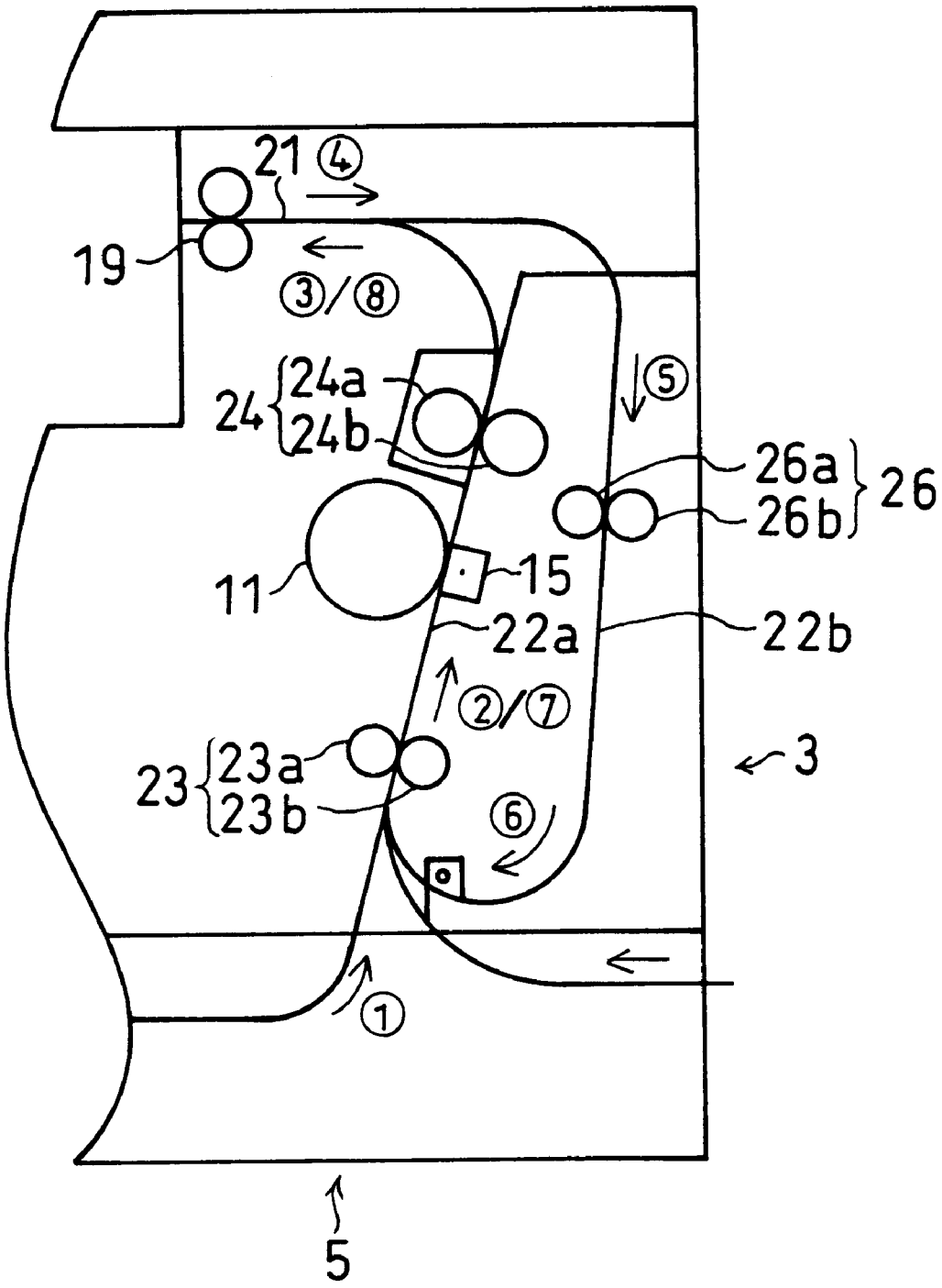
FIG. 3 is an explanatory drawing showing the flow of paper transport in the foregoing image forming device.

In FIG. 3, the numbers ① through ⑧, in the direction of transport of the paper P, show the flow of a sheet of paper P when forming images on both sides thereof, from the paper supply section 5, through the main transport channel 22*a*, the discharge transport channel 21, and the secondary transport channel 22*b*, through the main transport channel 22*a* and the discharge transport channel 21 again, to the discharge tray 20.

In the image forming device 1, when forming images on both sides of a sheet of paper P, after forming an image on the front side of the paper P (① through ③), the discharge rollers 19 reverse their direction of rotation while part of the paper P is held therebetween, guiding the paper P into the secondary transport channel 22*b* (④)

In this way, the direction of transport of the paper P is reversed, and it is transported to a point immediately before the resist rollers 23 (⑤ and ⑥ ). Then, when the resist rollers 23 begin to rotate, the paper P is guided between the photosensitive drum 11 and the transfer charger 15 with the back side of the paper P facing the photosensitive drum 11. An image is formed on the back side of the paper P (⑦), which is then transported to the discharge rollers 19 (⑧).

In the image forming device 1, the main transport channel 22*a* is made up of members which face the respective sides of the paper P. In the main transport channel 22*a*, members to the right of the paper P in the Figure, i.e., facing the side of the paper P an image is not formed on, include the resist roller 23*b* and the transfer charger 15. Members to the left of the paper P in the Figure, i.e., facing the side of the paper P an image is formed on, include the resist roller 23*a*, the photosensitive drum 11, and the fixing rollers 24.

Further, in the image forming device 1, the secondary transport channel 22*b* is provided with transport rollers 26. The secondary transport channel 22*b*, like the main transport channel 22*a*, is made up of members which face the respective sides of the paper P. In the secondary transport channel 22*b*, members to the right of the paper P in the Figure, facing the side on which an image will later be formed in the main transport channel 22*a*, include the transport roller 26*b*. Members to the left of the paper P in the Figure, facing the side on which an image was previously formed in the main transport channel 22*a*, include the transport roller 26*a*.

Figure 4:
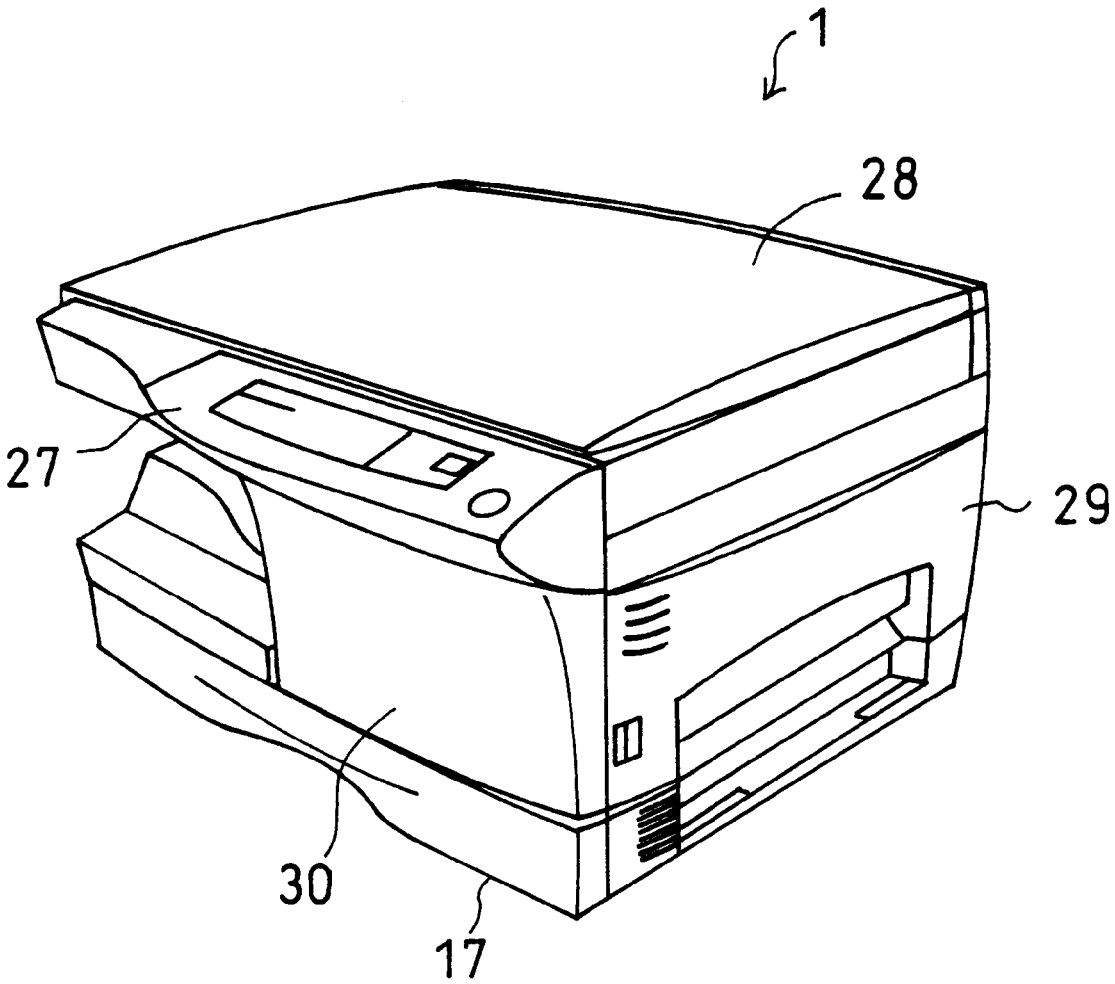
FIG. 4 is a perspective view showing the foregoing image forming device, with a side cover and a front cover closed.

FIG. 4 is a perspective view of the image forming device 1, showing the paper cassette 17 containing the paper P, an operating section 27 including a ten-key pad and a display section, an OC cover 28 which presses down on an original document from above, a side cover 29 (first opening/closing structure) provided in the side of the device main body (the side where the image forming section 3 is provided) , and a front cover 30 (second opening/closing structure) provided in the front of the device main body, each of which can be opened and closed.

Figure 5:
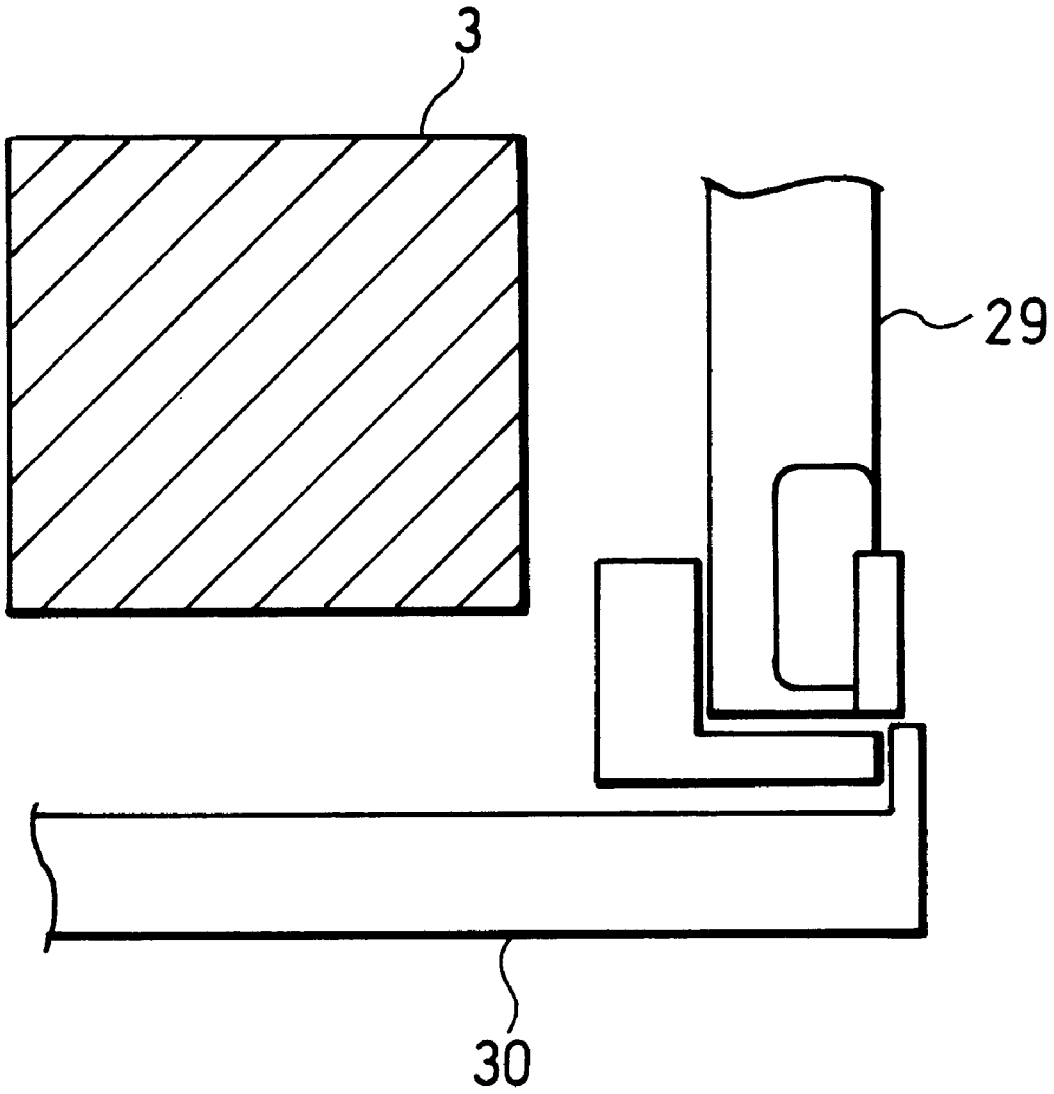
FIG. 5 is a transverse cross-sectional view schematically showing a part of the foregoing image forming device when viewed from above.

FIG. 5 is a cross-sectional view schematically showing the side cover 29 and part of the front cover 30 of the image forming device 1.

FIGS. 4 and 5 show the image forming device 1 with the side and front covers 29 and 30 closed. The side and front covers 29 and 30 are provided on adjacent sides of the main body of the image forming device 1, and can be opened and closed.

The side cover 29 is provided with a supporting hinge (not shown) extending vertically along an edge thereof toward the rear of the device main body, on which the side cover 29 can be opened from the edge thereof toward the front of the device main body. Since the side cover 29 swings open on the supporting hinge, the main transport channel 22*a* of the image forming section 22*b* can be exposed. The front cover 30, on the other hand, is supported by a hinge extending horizontally along the lower edge thereof, by means of which the front cover 30 can be opened from the upper edge thereof.

In the image forming device 1 according to the present embodiment, by providing the side cover 29 and the front cover 30 in the device main body, it is easy to perform maintenance of the various devices making up the image forming section 3. In addition, in the event of, for example, a paper jam, necessary maintenance operations, removal of the jammed paper, etc. can be performed by opening the side cover 29 and/or the front cover 30.

Figure 6:
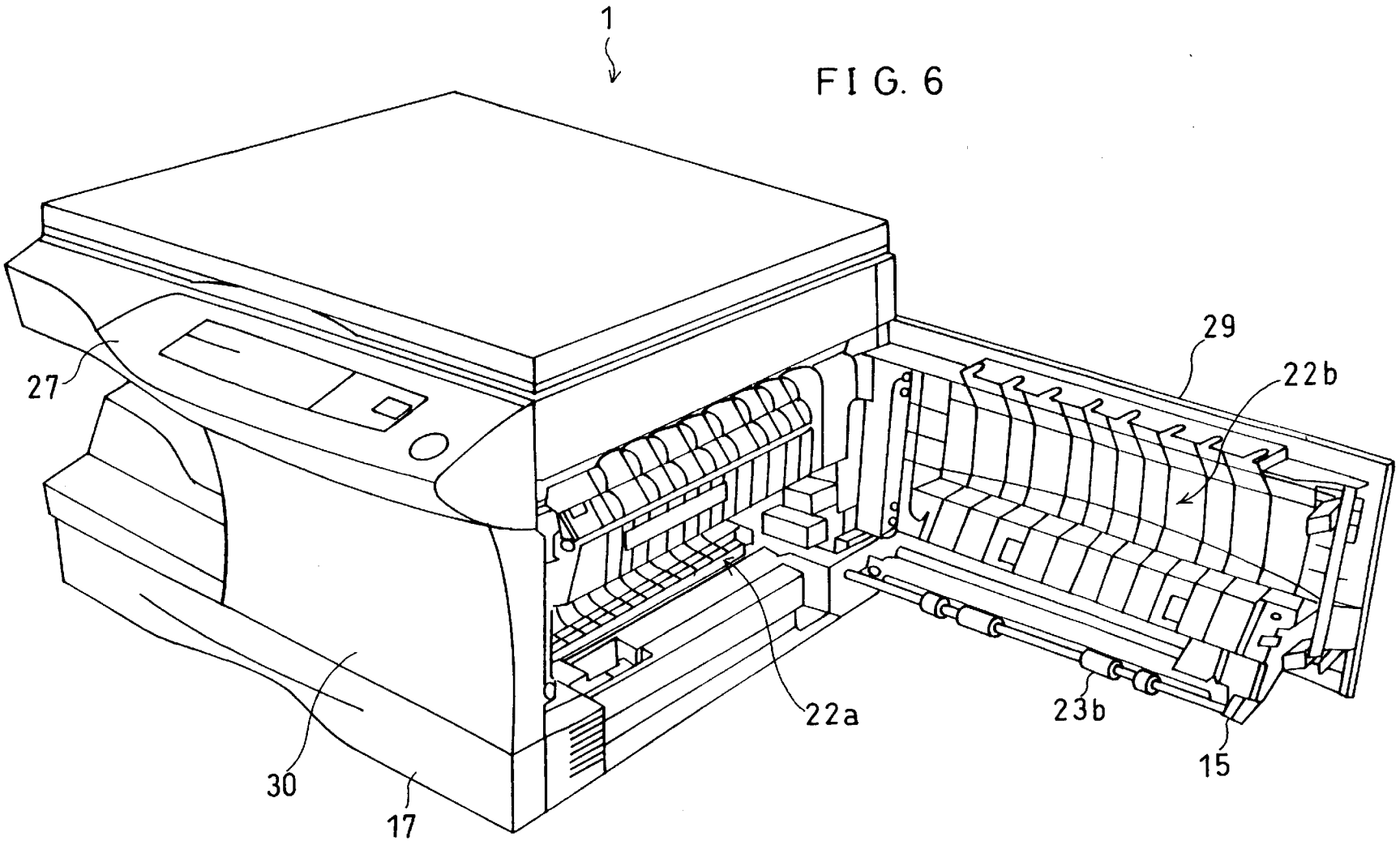
FIG. 6 is a perspective view showing the foregoing image forming device, with the transport channel exposed.

FIG. 6 shows the image forming device 1 with the side cover 29 opened to expose the main transport channel 22*a*, in order to perform operations such as removal of jammed paper. In the side cover 29, which is provided on the right side of the main body of the image forming device 1 when viewed from the front, members of the main transport channel 22*a* to the right of the paper P, facing the side of the paper P an image is not formed on (including the resist roller 23*b* and the transfer charger 15) and the members of the secondary transport channel 22*b* are provided integrally with the side cover 29. Further, the side cover 29 swings open on the supporting hinge (not shown) extending vertically along one lateral edge thereof.

As shown in FIG. 6, when the side cover 29 is opened out from the device main body, the members of the main transport channel 22*a* to the right of the paper P (including the resist roller 23*b* and the transfer charger 15) and the members of the secondary transport channel 22*b* (including the transport rollers 26) swing open on the supporting hinge integrally with the side cover 29. Further, upper and lower parts of the main transport channel 22*a* are also separated from the members thereof to the left of the paper P, facing the side an image is formed on (including the resist roller 23*a* and the photosensitive drum 11), and open away from the device main body integrally with the side cover 29. By this means, a large extent of the transport surface of the main transport channel 22*a* facing the front cover 30, from near the paper supply section 5 to near the fixing section, can be opened a fixed interval.

By means of the foregoing structure, the part of the transport channels toward the bottom of the image forming section 3, where paper jams are likely to occur, can be opened widely, thus simplifying the removal of jammed paper.

Figure 7:
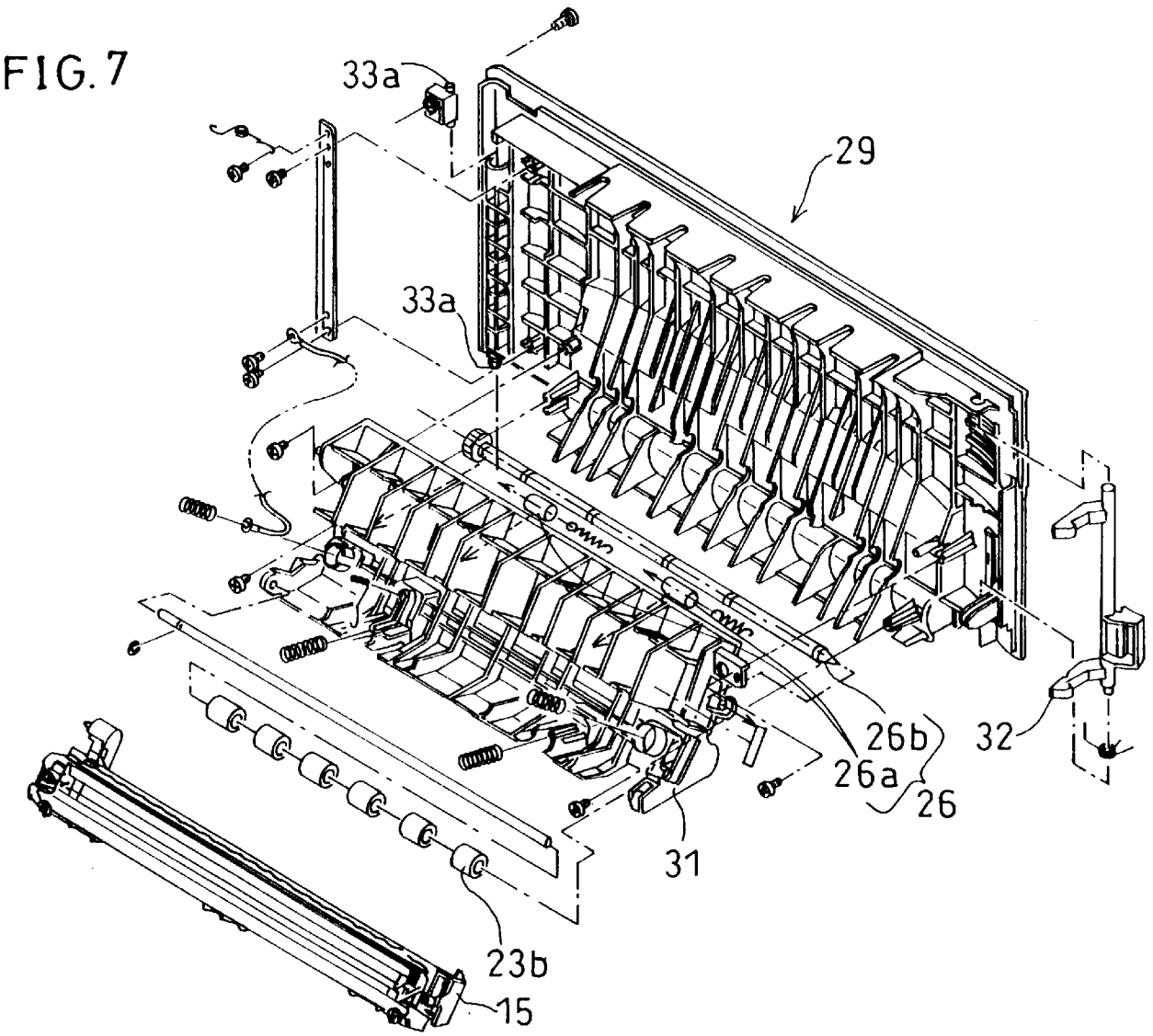
FIG. 7 is an exploded view showing the structure of the side cover of the foregoing image forming device.

FIG. 7 is an exploded drawing showing the structure of the side cover 29, integrally provided with the resist roller 23*b*, the transfer charger 15, and the transport rollers 26. The resist roller 23*b* and the transfer charger 15 are attached by screws to a transport body 31 made up of one transport surface of the main transport channel 22*a* and one transport surface of the secondary transport channel 22*b*, and the transport body 31 is itself attached by screws to the side cover 29.

Further, one end of the side cover 29 is provided with a lock section 32, which locks the side cover 29 in order to hold it against the device main body when closed. At the other end of the side cover 29 is provided a supporting hinge 33*a*, which allows the side cover 29 to open out from the device main body.

Figure 8:
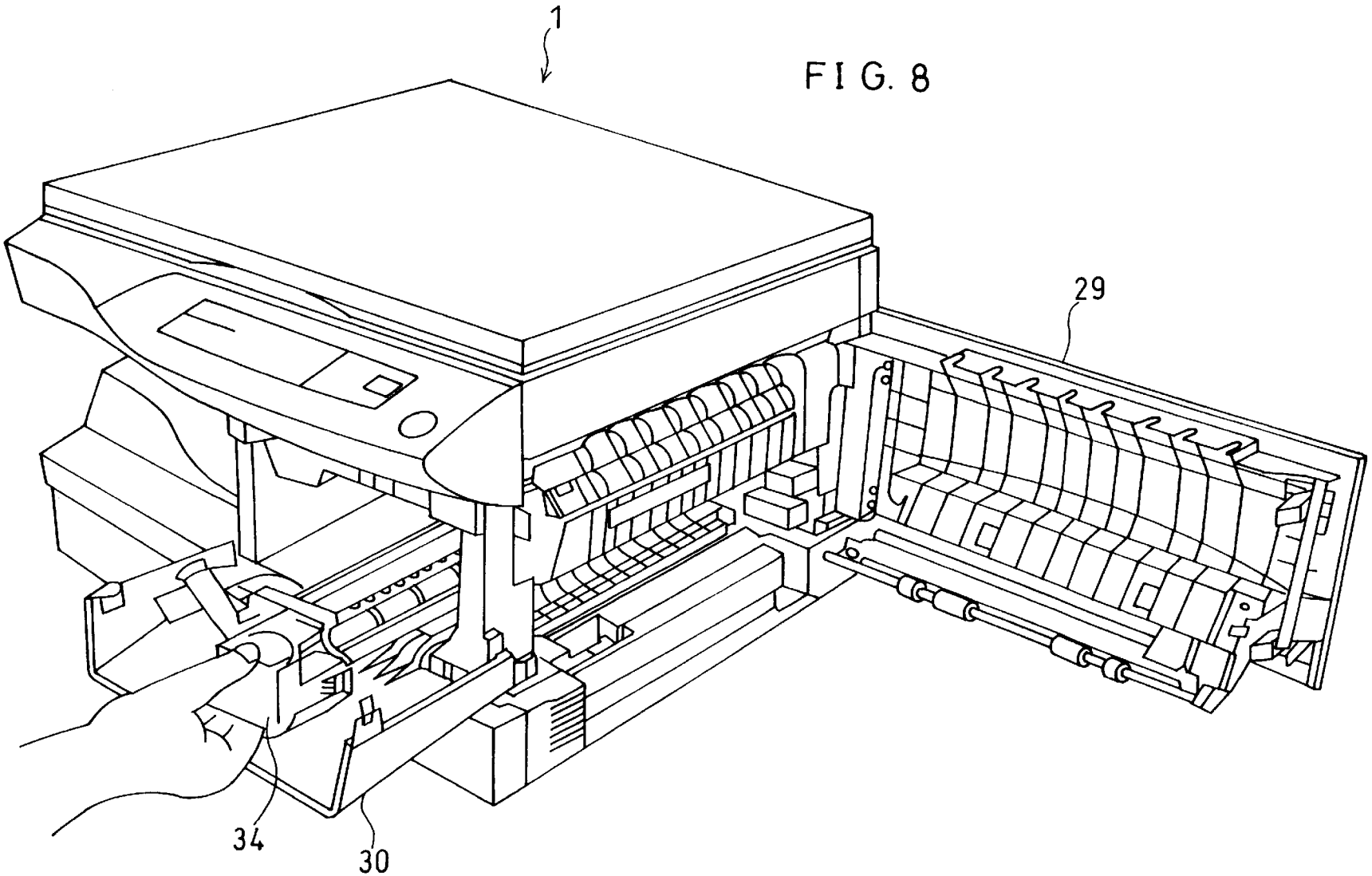
FIG. 8 is a perspective view showing pulling out of a replacement unit from the foregoing image forming device.

FIG. 8 is a drawing showing pulling out of a replacement unit from the image forming device 1. When the side cover 29 is open, the front cover 30 can be opened, and with the front cover 30 open, a replacement unit 34, integrally provided with the photosensitive drum 11, the charger 12, and the cleaning device 16, can be pulled out.

In this way, the image forming device 1 according to the present embodiment is structured so that the front cover 30 cannot be opened unless the side cover 29 is open. Accordingly, when replacing the replacement unit 34, the transport surface of the main transport channel 22*a* is definitely exposed.

By this means, when pulling out the replacement unit 34 while paper is jammed inside the main transport channel 22*a*, damage to the surface of the photosensitive drum 11 by a sharp edge of jammed paper can be avoided.

The following will explain in detail a structure for realizing the foregoing order of opening and closing the side cover 29 and the front cover 30.

Figure 9:
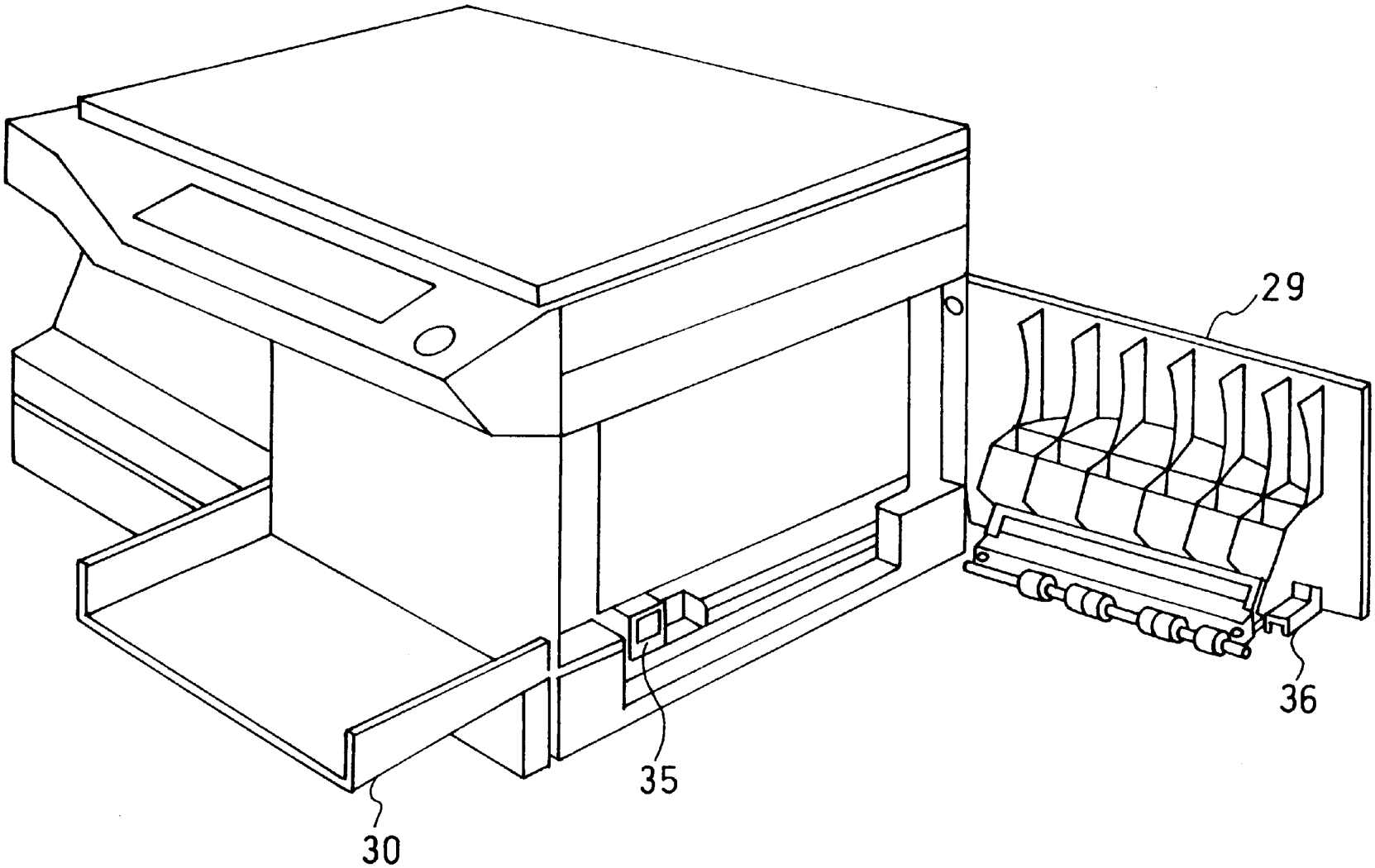
FIG. 9 is a perspective view of the foregoing image forming device, showing a positional relationship between a safety switch provided on the main body and a projection provided on the side cover.

FIG. 9 is a drawing showing a positional relationship between a safety switch 35 (switch) provided on the device main body and a projection 36, provided on the side cover 29, for pressing the safety switch 35 and switching it from OFF to ON.

When the side cover 29 is closed after closing the front cover 30, the projection 36 provided on the side cover 29 presses the safety switch 35, which is switched from OFF to ON. By this means, the main engine of the image forming device 1 is put in operation, and the image forming device 1 is put in a stand-by state, in which copying is possible.

Figure 10:
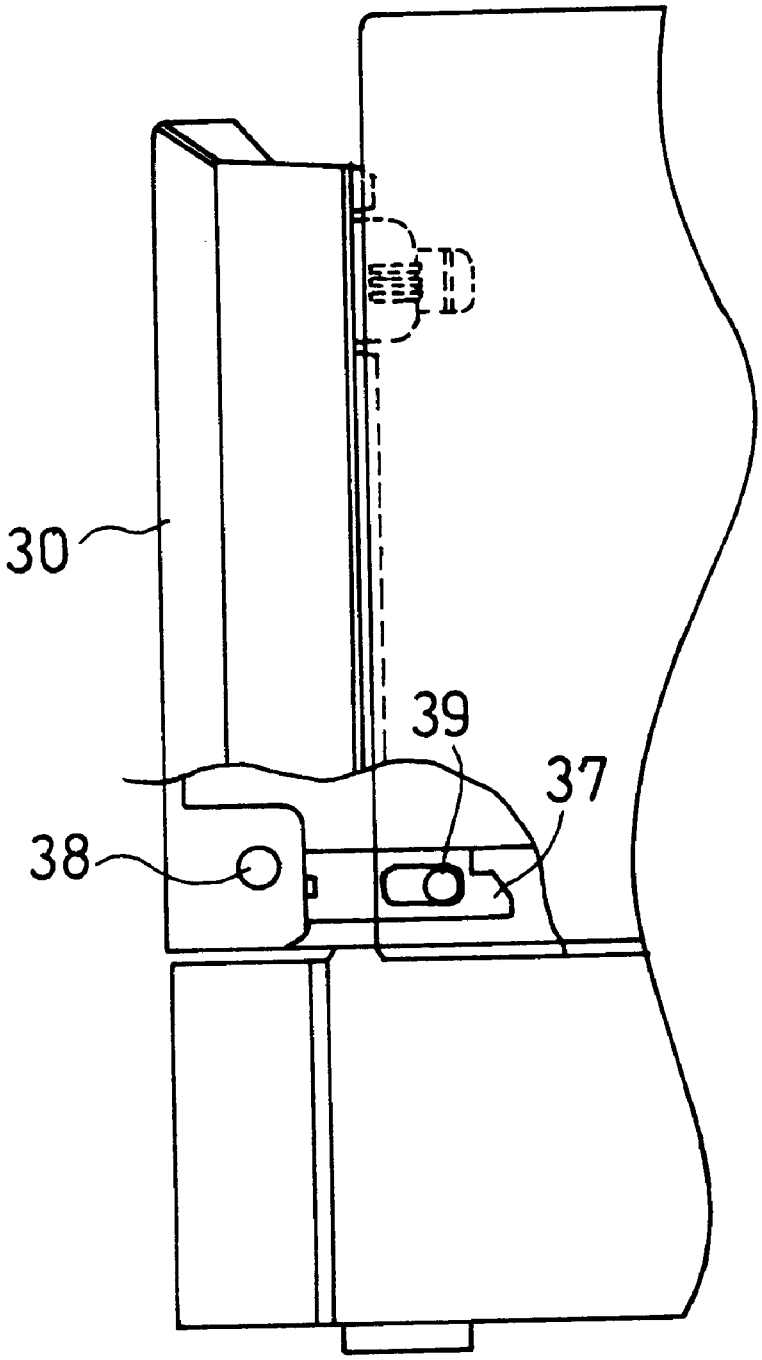
FIG. 10 is an explanatory drawing, partially cut away, showing the front cover of the foregoing image forming device when closed.
Figure 11:
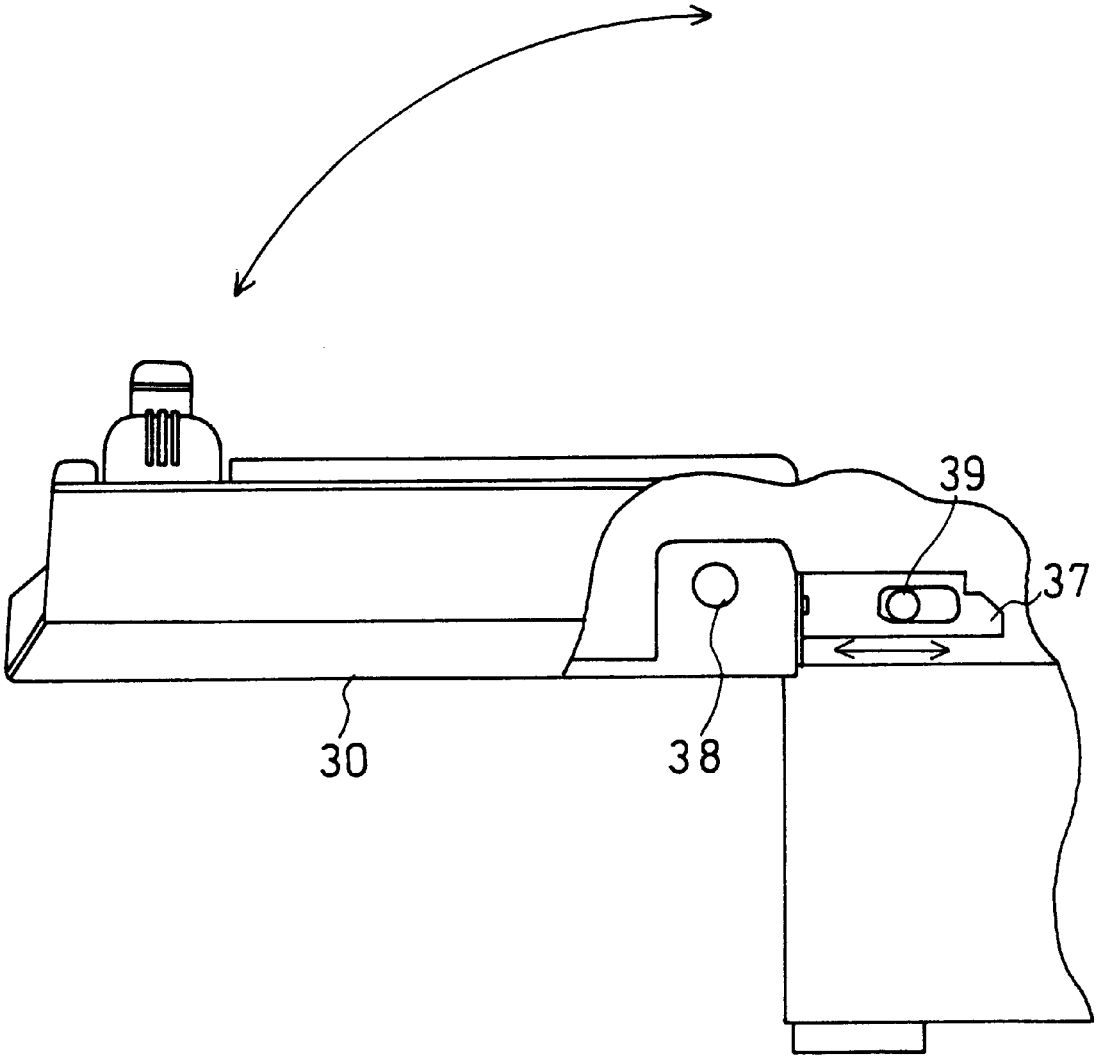
FIG. 11 is an explanatory drawing, partially cut away, showing the front cover of the foregoing image forming device when open.

FIG. 10 is a drawing showing the front cover 30 when closed, and FIG. 11 is a drawing showing the front cover 30 when open.

In the lower part of the end of the front cover 30 toward the side cover 29, an obstructing body 37 (opening/closing restricting member) is provided integrally with the front cover 30. The obstructing body 37 prevents closing of the side cover 29 while the side cover 29 is open.

The front cover 30 can be opened on a supporting hinge 38 provided along the lower edge of the front cover 30. When the front cover 30 is opened, the obstructing body 37 slides along an obstructing body guide pin 39, and protrudes from the front cover 30.

Figure 12:
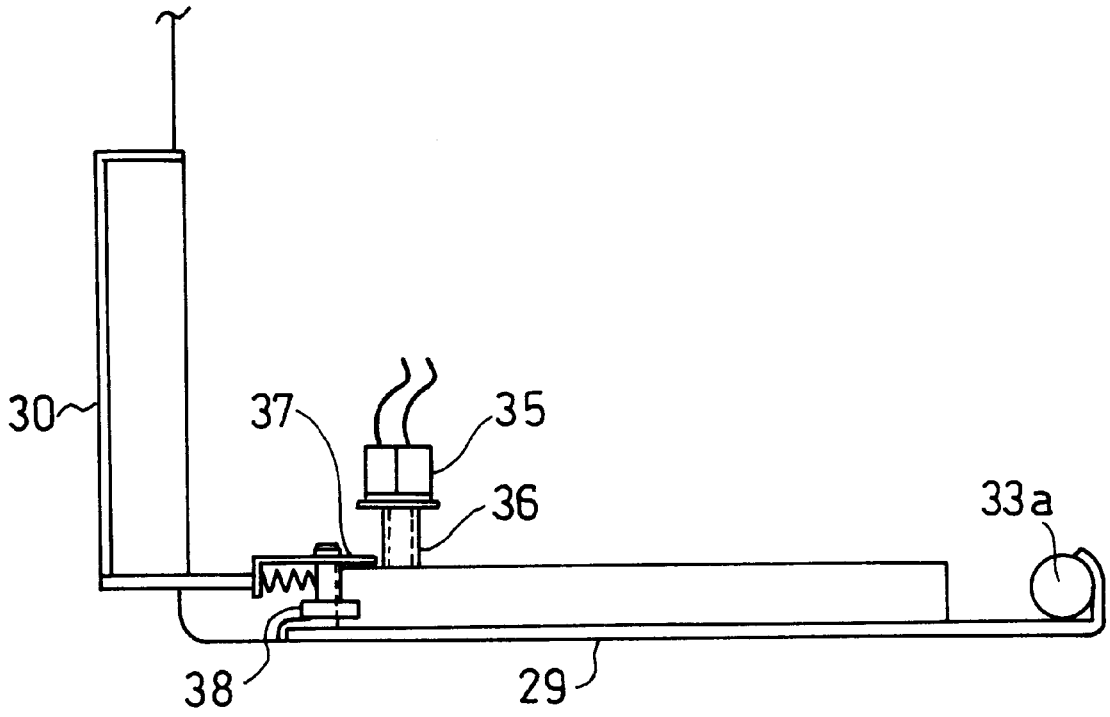
FIG. 12 is an explanatory drawing showing the projection provided in the side cover of the foregoing image forming device pressing the safety switch provided in the main body thereof, when the front cover is closed.

FIG. 12 is a drawing showing the projection 36 provided on the side cover 29 pressing the safety switch 35 provided in the device main body, when the front cover 30 is closed. Further, FIG. 13 is a drawing showing how, when the front cover 30 is open, the obstructing body 37 provided on the front cover 30 prevents the projection 36 provided on the side cover 29 from pressing the safety switch 35 provided in the device main body.

As shown in FIG. 12, if the side cover 29 is closed when the front cover 30 is closed, the projection 36 provided on the side cover 29 presses the safety switch 35 in the device main body. Accordingly, the safety switch is switched from OFF to ON, and the image forming device 1 is put in a stand-by state which enables copying.

Figure 13:
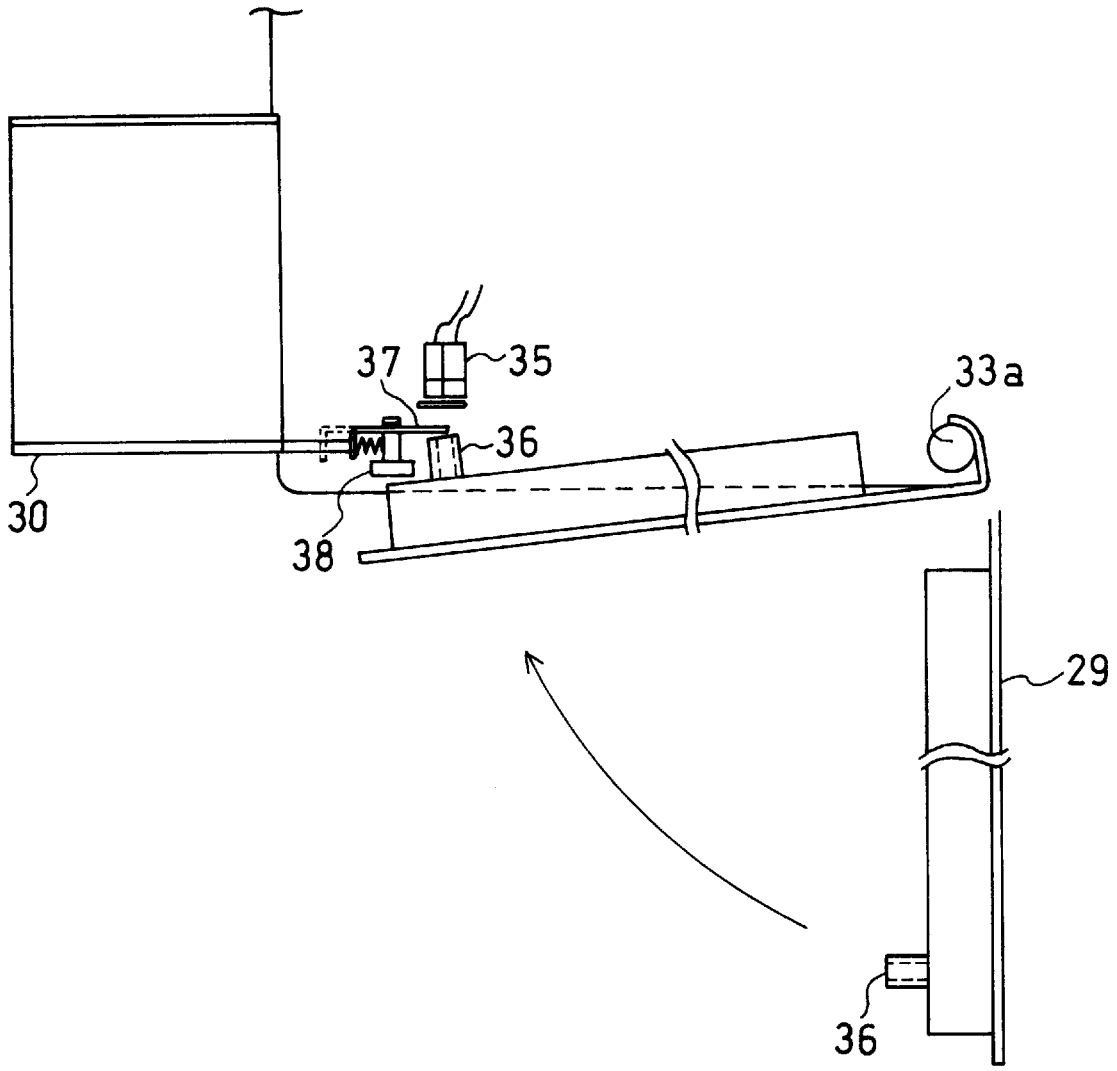
FIG. 13 is an explanatory drawing showing how the projection provided in the side cover of the foregoing image forming device is prevented from pressing the safety switch provided in the main body thereof when the front cover is open.

As shown in FIG. 13, on the other hand, if the operator attempts to close the side cover 29 when the front cover 30 is open, the obstructing body 37 protrudes between the safety switch 35 provided in the device main body and the projection 36 provided on the side cover 29, thus preventing the side cover 29 from closing. Accordingly, the projection 36 provided on the side cover 29 is prevented from pressing the safety switch 35 provided in the device main body, and the image forming device 1 cannot be put in a stand-by state which enables copying.

Further, if the operator attempts to open the front cover 30 when both the side and front covers 29 and 30 are closed, the obstructing body 37 comes into contact with the projection 36 and is unable to protrude, and thus the front cover 30 cannot be opened.

By the foregoing structure, the side and front covers 29 and 30 can be given an order of opening and closing.

In the image forming device 1 as discussed above, the supporting hinge 33*a* of the side cover 29 is provided extending vertically along the edge of the side cover 29 toward the rear of the device main body. However, as another example of the image forming device 1 according to the present embodiment, it is also possible to provide a supporting hinge in the position described below.

Figure 14:
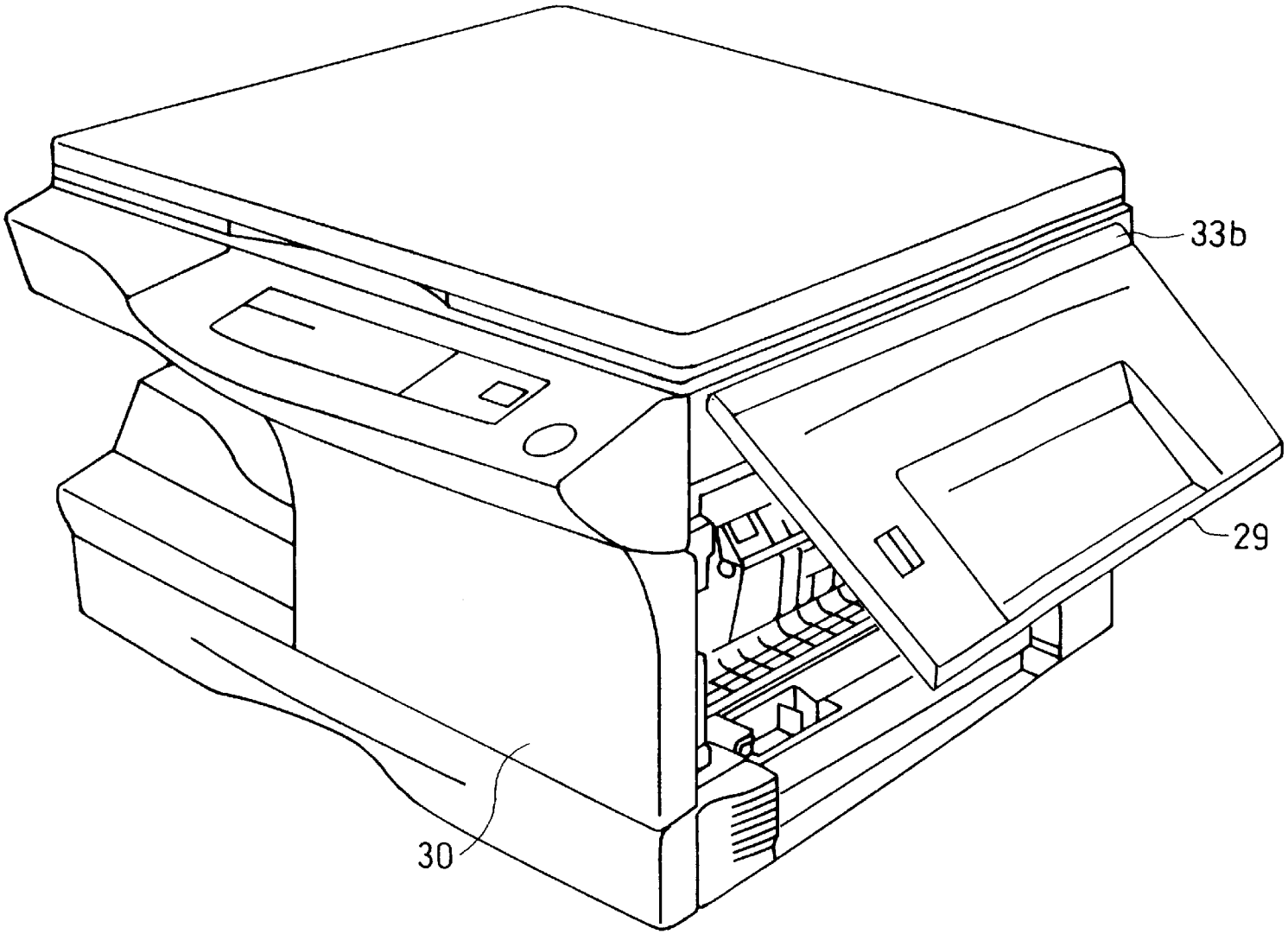
FIG. 14 is a perspective view showing a modification of the foregoing image forming device.

FIG. 14 is a drawing showing a structure in which the side cover 29 is provided with a supporting hinge 33*b* along the upper edge of the side cover 29. Since the side cover 29 swings open on the supporting hinge 33*b*, the lower end of the side cover 29 opens upward. Since the side cover 29 opens upward, the lower part of the main and secondary transport channels 22*a* and 22*b*, where they turn sharply, can be exposed, and paper jammed in the vicinity of a PS (Paper Stop) roller (the resist rollers 23) can be reached. Thus it is easy to remove paper jammed in this vicinity.

Figure 15:
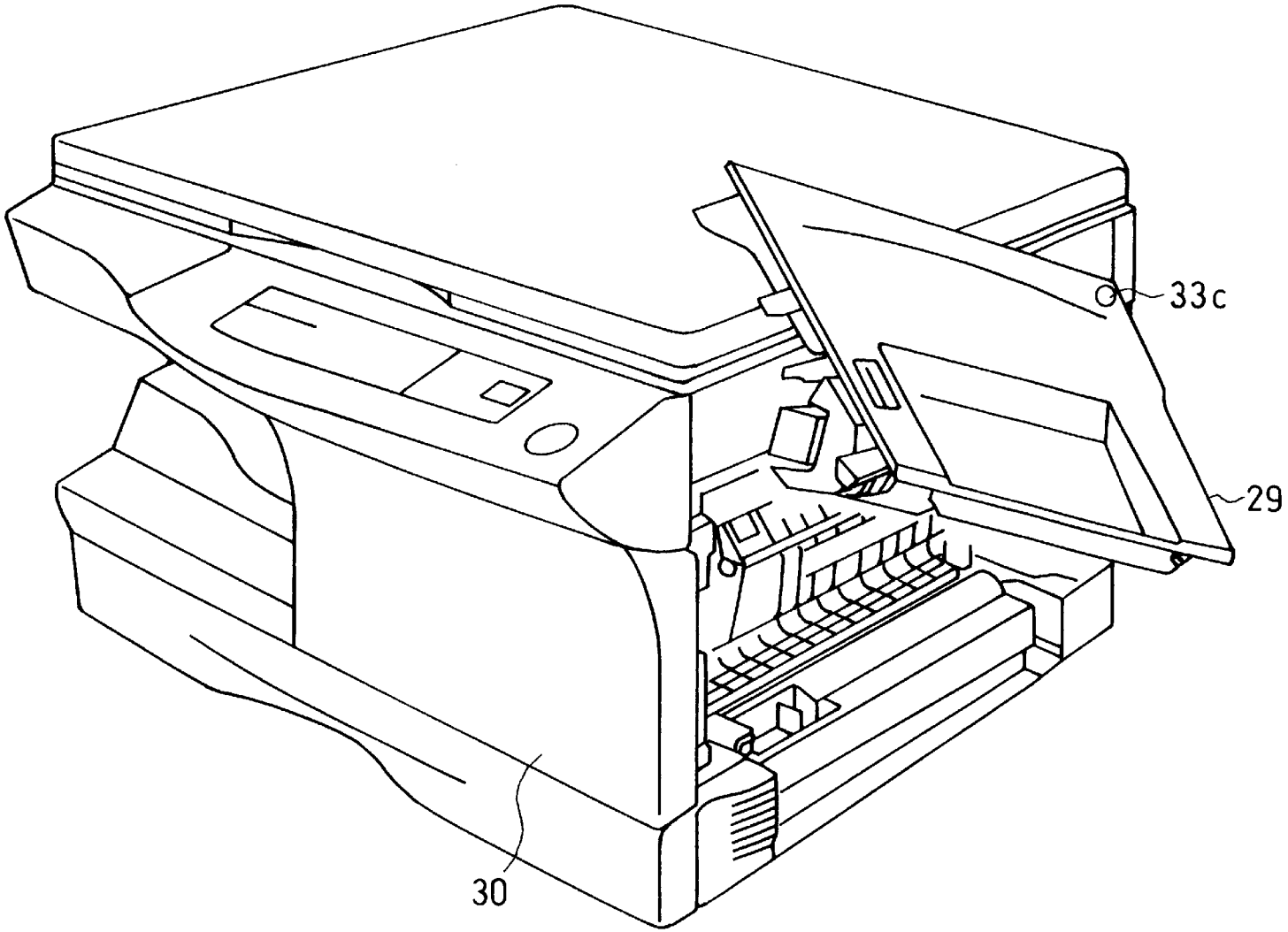
FIG. 15 is a perspective view showing another modification of the foregoing image forming device.

As another example of the image forming device 1 according to the present embodiment, shown in FIG. 15, the side cover 29 can be provided with a fulcrum 33*c* instead of the supporting hinge 33*a* or 33*b*. The fulcrum 33*c* is provided in the upper corner of the edge of the side cover 29 toward the rear of the device main body, and is formed by engaging a concave portion provided in the device main body with a convex portion provided on the side cover 29. By opening the side cover 29 by swinging it on the fulcrum 33*c*, the lower part of the main and secondary transport channels 22*a* and 22*b*, where they turn sharply, can be exposed, and paper jammed in the vicinity of a PS roller (the resist rollers 23) can be reached. Thus it is easy to remove paper jammed in this vicinity.

Figure 16:
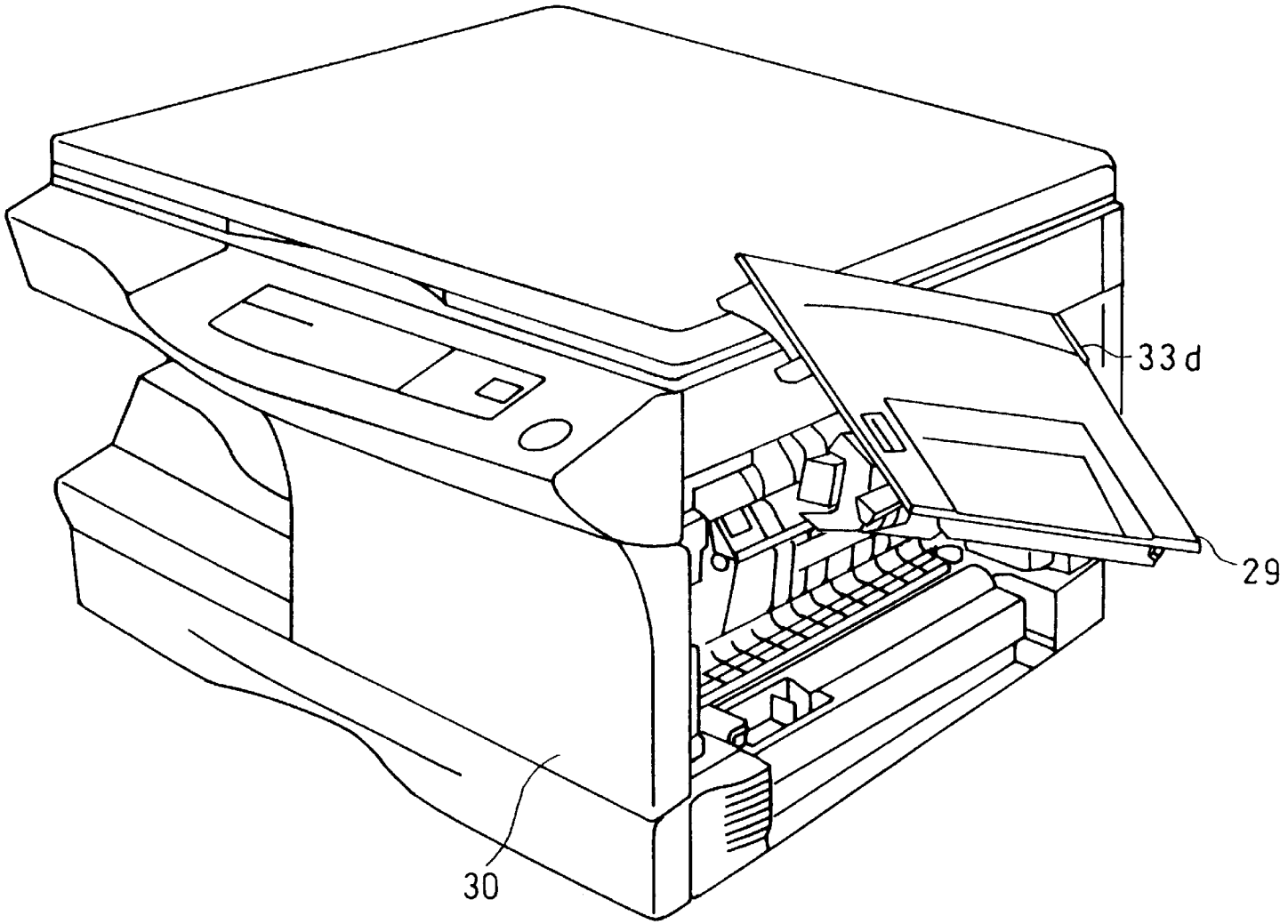
FIG. 16 is a perspective view showing a further modification of the foregoing image forming device.

As another example of the image forming device 1 according to the present embodiment, shown in FIG. 16, a supporting hinge 33*d* extending diagonally can be provided in the upper corner of the edge of the side cover 29 toward the rear of the device main body. By providing such a diagonal supporting hinge 33*d*, the side cover 29 opens upward diagonally, and thus the lower part of the main and secondary transport channels 22*a* and 22*b*, where they turn sharply, can be exposed, and paper jammed in the vicinity of a PS roller (the resist rollers 23) can be reached. Thus it is easy to remove paper jammed in this vicinity.

As discussed above, with the image forming device 1 according to the first embodiment of the present invention, since a door on a side of the device main body is provided with a supporting hinge in an upper or lateral part thereof, an edge of paper jammed in the vicinity of a PS roller (the resist rollers 23) can be reached by opening the door only partially, without opening it fully, unlike in conventional image forming devices structured so that a door on the side of the device main body opens out on a supporting hinge provided along the lower edge thereof. Thus it is easy to remove paper jammed in this vicinity.

Further, in the secondary transport channel 22*b*, which is shaped roughly like a rectangle open on the left, paper is likely to jam where the transport path turns, especially at a point where a transport channel from the paper supply section 5 in the lower part of the device main body, a transport channel from a hand-feed tray, and the secondary transport channel 22*b* meet. However, since the image forming device 1 according to the present embodiment is structured so that a door on a side of the device main body opens on a supporting hinge provided in an upper or lateral part thereof, instead of a lower part thereof, the secondary transport channel 22*b* can be opened out widely from the device main body, and paper jammed in the secondary transport channel 22*b* can be easily removed.

Moreover, with the image forming device 1 according to the present embodiment, doors on the front and side of the device main body can be given an order of opening and closing by means of a simple structure, without necessitating additional structural members.

In addition, in the present embodiment, when replacing the replacement unit 34, the transport surface of the main transport channel 22*a* is definitely exposed. Accordingly, when, for example, replacing the photosensitive drum 11 while paper is jammed in the main transport channel 22*a*, damage to the surface of the photosensitive drum 11 by a sharp edge of jammed paper can be avoided.

[SECOND EMBODIMENT]

The following will explain another embodiment of the present invention with reference to FIGS. 17 through 22. For ease of explanation, members having the same functions as those explained in the first embodiment above will be given the same reference symbols, and explanation thereof will be omitted here.

Figure 17:
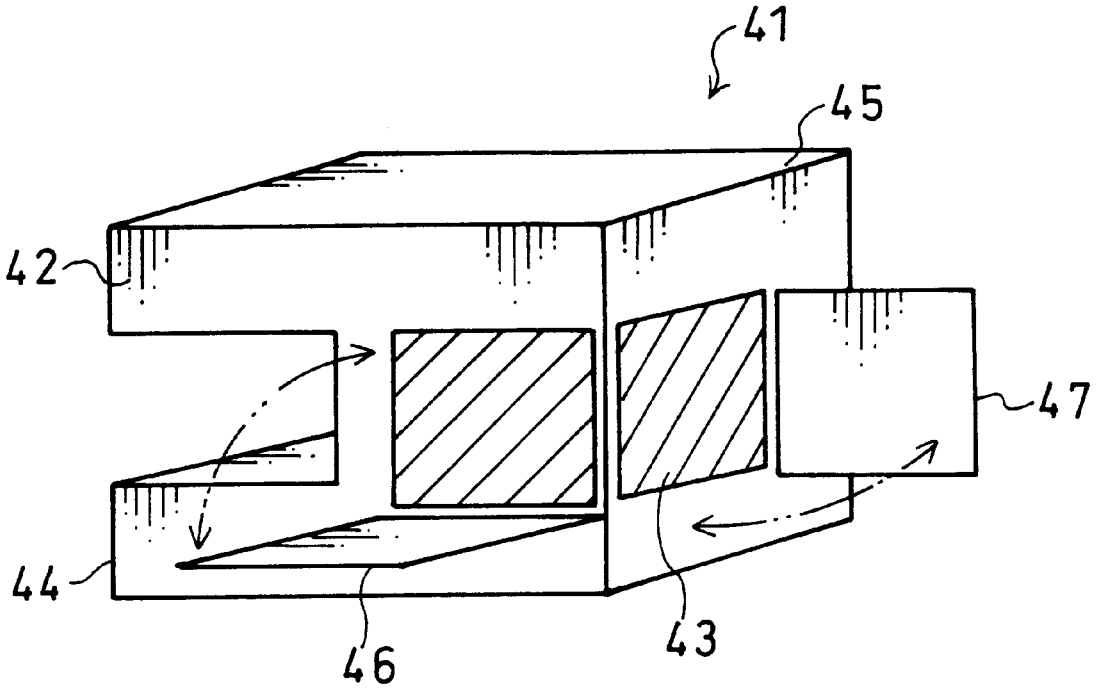
FIG. 17 is a perspective view schematically showing the structure of an image forming device according to the second embodiment of the present invention.

As shown in FIG. 17, an image forming device 41 according to the present embodiment includes an original reading section 42 for reading an original, an image forming section 43 (including a second transport channel) for forming on recording paper (transfer paper) an image corresponding to the read original, a paper supply section 44 (including a first transport channel) for storing recording paper, and a housing 45.

In the present embodiment, the image forming section 43 and the paper supply section 44 have functions substantially the same as those of the image forming section 3 and the paper supply section 5 of the first embodiment above.

The image forming device 41 is also provided with a front cover 46 (second opening/closing structure) in the front of the image forming device 41, and a side cover 47 (first opening/closing structure) in a side of the image forming device 41, each of which can be opened and closed. The front and side covers 46 and 47 cover two sides of the image forming section 43.

The front and side covers 46 and 47 are provided on two adjacent sides of the image forming device 41 (the front and one side thereof), and can be opened and closed. The front cover 46 is supported along, for example, the lower edge thereof, so it can swing open vertically.

The side cover 47 is supported along, for example, an edge thereof toward the rear of the image forming device 41, so it can swing open horizontally. By providing the side cover 47 so as to open in this way, as with the side cover 29 of the first embodiment above, the lower part of the image forming section 43, where paper jams are likely, can be opened widely, and it is easy to perform operations such as removal of jammed paper.

Figure 18:
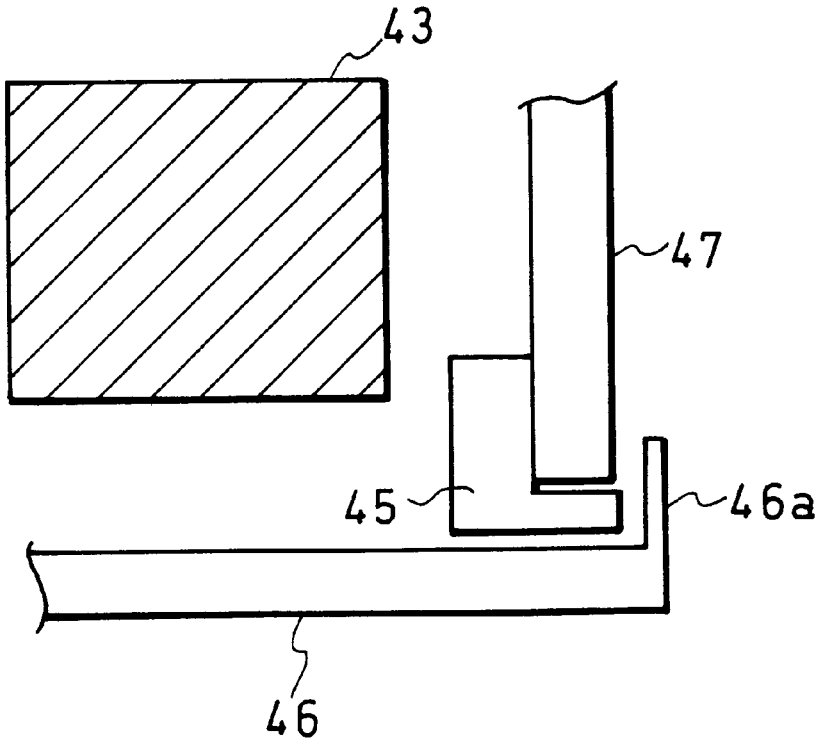
FIG. 18 is a transverse cross-sectional view of the main part of the foregoing image forming device.
Figure 19:
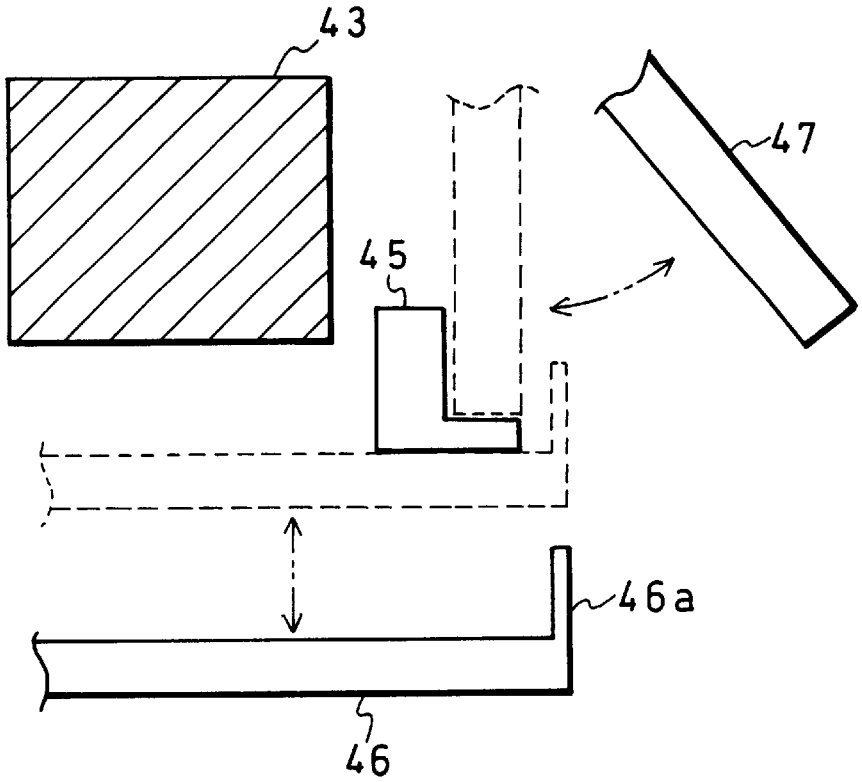
FIG. 19 is an explanatory drawing showing opening and closing of a front cover and a side cover of the foregoing image forming device.

As shown in FIG. 18, at the end of the front cover 46 toward the side cover 47, an obstructing body 46*a* (opening/closing restricting member) is provided integrally with the front cover 46. When both the side and front covers 46 and 47 are closed, the obstructing body 46*a* covers the end of the side cover 47 toward the front of the image forming device 41 (the opening end of the side cover 47), thus preventing the side cover 47 from opening.

In the image forming device 41 according to the present embodiment, when performing maintenance of the various devices of the image forming section 43, or in the event of a paper jam, it is easy to perform the maintenance or to remove the jammed paper by opening the front cover 46 and/or the side cover 47.

With the foregoing structure, since part of the opening end of the side cover 47 is covered by the obstructing body 46*a* of the front cover 46, the side cover 47 cannot be opened when the front cover 46 is closed.

Figure 20:
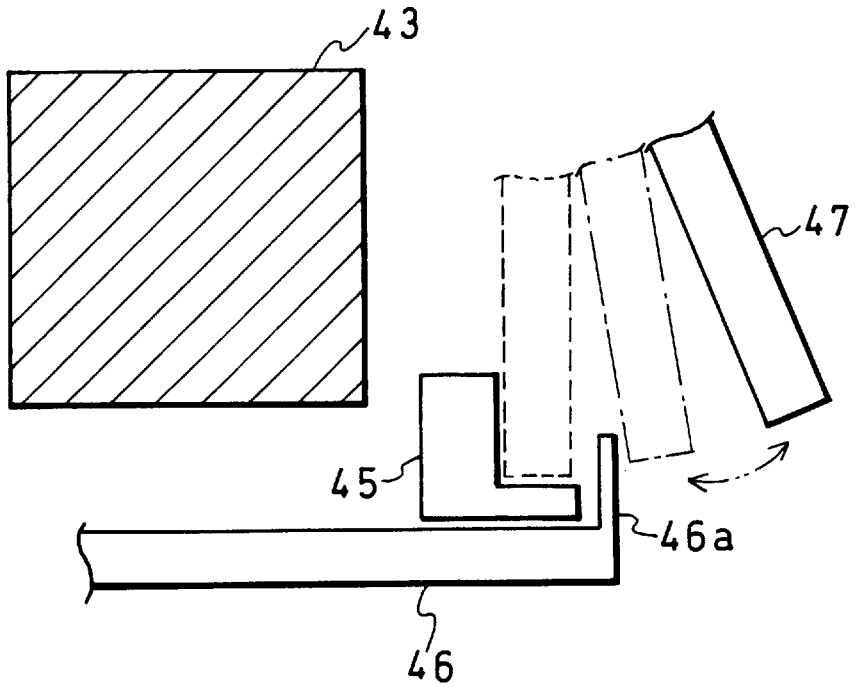
FIG. 20 is an explanatory drawing showing closing of the side cover of the foregoing image forming device when the front cover is already closed.

Further, when both the front cover 46 and the side cover 47 are open (as shown by solid lines in FIG. 19) and the operator closes the front cover 46 first (as shown in FIG. 20), the obstructing body 46*a* of the front cover 46 prevents the side cover 47 from closing. Accordingly, the operator can be prevented from leaving the side cover 47 open.

In this way, in the image forming device 41 according to the present embodiment, there is an order of opening and closing the front and side covers 46 and 47, and they cannot be opened and closed unless this order is followed.

Figure 21:
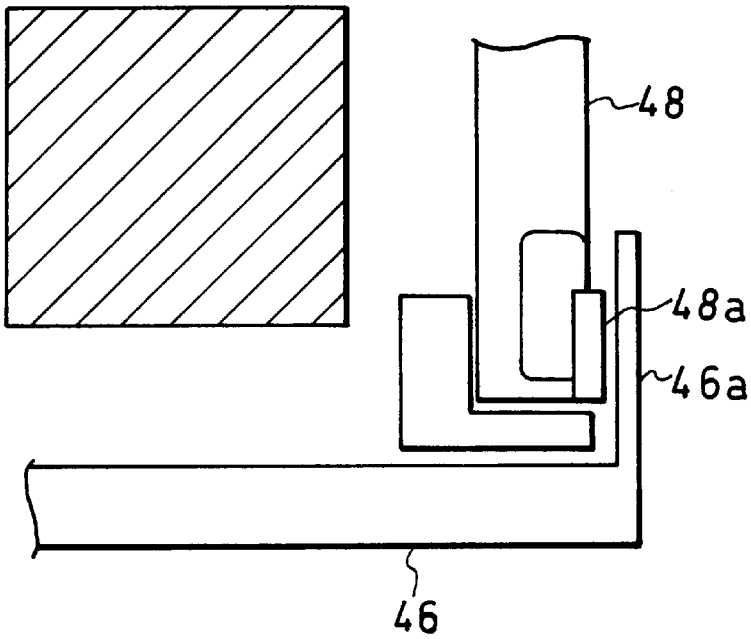
FIG. 21 is a transverse cross-sectional view showing a modification of the front cover of the foregoing image forming device.

Next, a side cover 48, as a modification of the side cover 47 in the image forming device 41, will be explained with reference to FIG. 21.

The portion of the side cover 48 which is covered by the obstructing body 46*a* of the front cover 46 is provided with an opening/closing handle 48*a* (handle) for opening and closing the side cover 48. Accordingly, when the front cover 46 is closed, the operator cannot grasp the opening/closing handle 48*a* of the side cover 48, and thus cannot open the side cover 48.

Figure 22:
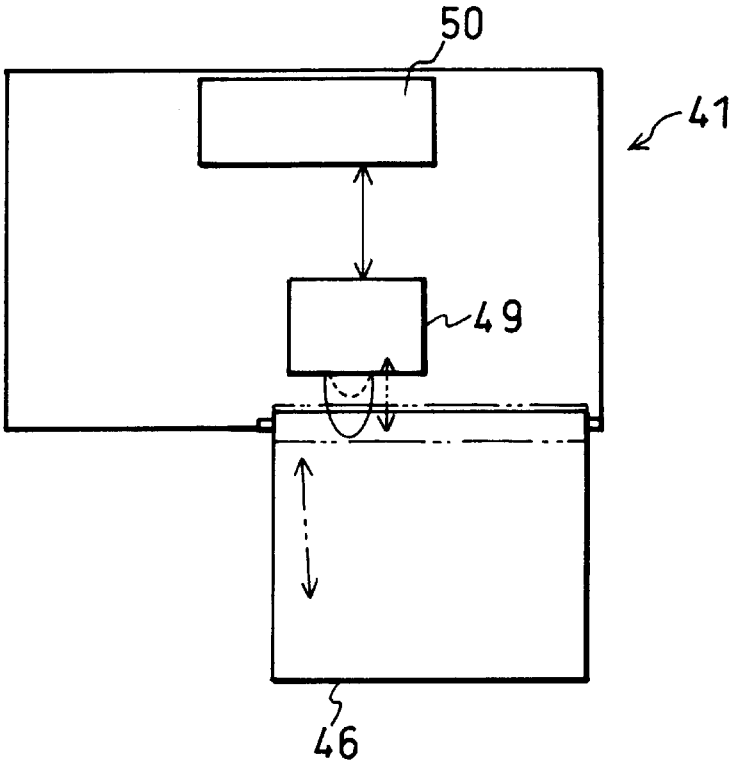
FIG. 22 is an explanatory drawing showing a modification of the foregoing image forming device.

The image forming device 41 can also be structured as shown in FIG. 22, so as to provide in the front of the image forming device 41 (toward the side on which the front cover 46 is provided) a switch 49, which is ON/OFF operated by opening and closing of the front cover 46. The switch 49 is structured so that ON/OFF operation thereof controls ON/OFF operation of a power source section 50 of the image forming device. In this structure, when the front cover 46 is opened to perform maintenance of the image forming section 43, removal of jammed paper, etc., the switch 49 is turned off, thus turning off the power source section 50 and cutting off power to the image forming device 41. By this means, the foregoing operations can be performed in safety, with the main engine of the image forming device 41 turned off.

As discussed above, in the present embodiment, part of the side cover 47 is covered by the obstructing body 46*a* provided integrally with the front cover 46. Accordingly, when the front cover 46 is closed, the obstructing body 46*a* prevents the side cover 47 from opening. Further, if the operator attempts to close the side cover 47 after closing the front cover 46, the obstructing body 46*a* prevents the side cover 47 from closing. In other words, the front and side covers 46 and 47 can be given an order of opening and closing by means of a simple structure, without necessitating additional structural members.

Further, the side cover 48 can also be used in the foregoing structure, by means of which the opening/closing handle 48*a* cannot be grasped when the front cover 46 is closed, i.e., the side cover 48 cannot be opened. Accordingly, unexpected opening of the side cover 48 can be prevented with certainty.

[THIRD EMBODIMENT]

Figure 23:
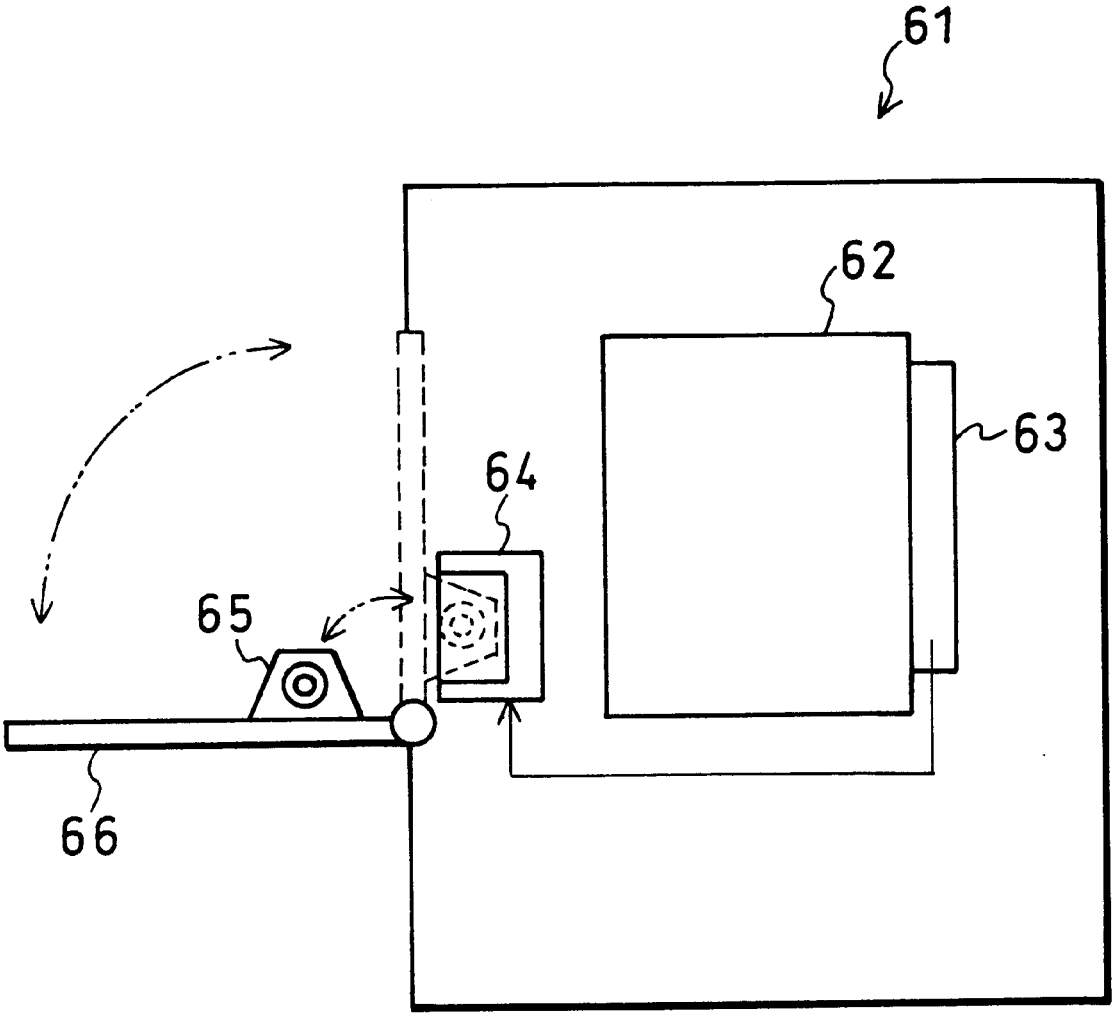
FIG. 23 is an explanatory drawing showing opening and closing of a front cover of an image forming device according to the third embodiment of the present invention.

The following will explain a further embodiment of the present invention with reference to FIG. 23. Members having the same functions as those explained in the second embodiment above will be given the same reference symbols, and explanation thereof will be omitted here.

As shown in FIG. 23, an image forming device 61 according to the present embodiment is structured as the image forming device 41 according to the second embodiment above, further including a paper discharge sensor 62 (paper discharge detecting means), which detects discharge of the paper after an image is formed thereon by the image forming section 43, and a paper jam sensor 63 (paper jam detecting means), which detects a paper jam during transport of the paper. The image forming device 61 is also provided with a lock structure 64 (means for locking the second opening/closing structure) in a position opposite a lock section 65 (means for locking the second opening/closing structure) to be discussed below, which locks closed a front cover 66 to be discussed below. The other structural members of the image forming device 61 are the same as those of the image forming device 41 of the second embodiment above.

In the present embodiment, a front cover 66 is structured as the front cover 46 in the second embodiment above, further including a lock section 65. When the front cover 66 is closed, the lock section 65 is held by a lock structure 64 provided in the device main body.

The other structure of the front cover 66 is the same as that of the front cover 46 of the image forming device 41 of the second embodiment above.

When operation of the image forming device 61 has stopped due to detection of discharge by the discharge sensor 62 or detection of a paper jam by the paper jam sensor 63, the lock structure 64 unlocks the lock section 65, allowing the front cover 66 to be opened.

By means of the foregoing structure, danger to the operator due to opening the front cover 66 during operation of the image forming device 61 can be prevented with certainty.

As discussed above, in the present embodiment, when operations of the image forming device 61 have stopped, the lock section 65 and the lock structure 64 (which collectively make up the locking means referred to in the claims) allow the front cover 66 to be opened. In other words, the front cover 66 cannot be opened while the image forming device 61 is operating. Accordingly, when opening the front cover 66 to perform operations such as maintenance of the various sections of the image forming device 61, removal of jammed paper, etc., danger to the operator due to operation of the image forming device 61 can be prevented with certainty.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations, provided such variations do not depart from the spirit of the present invention or exceed the scope of the patent claims set forth below.

What is claimed is:

1. An image forming device comprising:

a first transport channel located in a lower part of a main body of said device, for supplying transfer paper;

a second transport channel located in a side part of the device main body, in which an image is formed on transfer paper supplied from said first transport channel; and a first opening/closing structure provided on the side of the device main body where said second transport channel is provided, having in an upper or lateral part thereof a supporting hinge, on which the first opening/closing structure opens out from the device main body to expose at least a portion of said second transport channel toward said first transport channel.

2. The image forming device set forth in claim 1, further comprising:

a second opening/closing structure, provided on a side of the device main body adjacent to the side where said first opening/closing structure is provided, which opens out from the device main body to expose said second transport channel.

3. The image forming device as set forth in claim 1, wherein:

said first opening/closing structure is provided integrally with some structural members making up said second transport channel, and opens to expose a transport surface of said second transport channel.

4. The image forming device as set forth in claim 2, wherein:

said first opening/closing structure is provided integrally with some structural members making up said second transport channel, and opens to expose a transport surface of said second transport channel.

5. The image forming device set forth in claim 2, wherein:

said second opening/closing structure includes an opening/closing restricting member, which prevents closing of said first opening/closing structure when said second opening/closing structure is open, and allows opening and closing of said first opening/closing structure when said second opening/closing structure is closed.

6. The image forming device set forth in claim 1, further comprising:

a switch, provided in the device main body, which controls operation of the image forming device;

wherein said first opening/closing structure is provided with a projection in a position corresponding to said switch when said first opening/closing structure is closed, which performs switching of said switch.

7. The image forming device set forth in claim 2, further comprising:

a switch, provided in the device main body, which controls operation of the image forming device;

wherein said first opening/closing structure is provided with a projection in a position corresponding to said switch when said first opening/closing structure is closed, which performs switching of said switch.

8. The image forming device set forth in claim 1, wherein:

said supporting hinge of said first opening/closing structure is provided extending vertically along a lateral edge of said first opening/closing structure.

9. The image forming device set forth in claim 1, wherein:

said supporting hinge of said first opening/closing structure is provided extending horizontally along an upper edge of said first opening/closing structure.

10. The image forming device set forth in claim 1, wherein:

said supporting hinge of said first opening/closing structure is provided in an upper corner of a lateral edge of said first opening/closing structure, extending diagonally.

11. The image forming device set forth in claim 1, wherein:

said supporting hinge of said first opening/closing structure is a fulcrum provided in a corner of said first opening/closing structure.

12. The image forming device set forth in claim 2, wherein:

said second opening/closing structure includes an opening/closing restricting member provided on an end of said second opening/closing structure toward said first opening/closing structure, which covers part of said first opening/closing structure when said first and second opening/closing structures are closed, and prevents opening and closing of said second opening/closing structure when said first opening/closing structure is closed.

13. The image forming device set forth in claim 12, wherein:

said first opening/closing structure includes a handle for opening and closing the first opening/closing structure, provided in the part thereof which is covered by said opening/closing restricting member.

14. The image forming device set forth in claim 12, further comprising:

a switch, provided in the device main body, which stops operation of the image forming device when said second opening/closing structure is open.

15. The image forming device set forth in claim 12, further comprising:

paper discharge detecting means, which detect discharge of transfer paper with an image formed thereon, and stop operation of the image forming device.

16. The image forming device set forth in claim 12, further comprising:

paper jam detecting means, which detect a paper jam occurring in a transport channel, and stop operation of the image forming device.

17. The image forming device set forth in claim 12, further comprising:

locking means, which allow opening of said second opening/closing structure when operation of the image forming device is stopped.

18. The image forming device set forth in claim 1, wherein:

said supporting hinge of said first opening/closing structure is provided along a lateral edge thereof toward the rear of the device main body, so that a portion of said second transport channel toward said first transport channel and a portion of said second transport channel toward a front of the device main body can be exposed.

19. The image forming device set forth in claim 1, wherein:

said supporting hinge of said first opening/closing structure is a universal joint comprised of a concave section and a convex section which engage with one another.

20. The image forming device set forth in claim 1, wherein:

said second transport channel comprises a pair of opposing transport surfaces; and said first opening/closing structure includes an inner surface, and is adapted, when open, to expose at least a portion of one of said transport surfaces of said second transport channel toward said first transport channel, said at least a portion of one of said transport surfaces being formed integrally with said inner surface of said first opening/closing structure.

21. The image forming device set forth in claim 2, wherein:

said second transport channel comprises a pair of opposing transport surfaces; and said first opening/closing structure includes an inner surface, and is adapted, when open, to expose at least a portion of one of said transport surfaces of said second transport channel toward said first transport channel, said at least a portion of one of said transport surfaces being formed integrally with said inner surface of said first opening/closing structure.

* * * * *